US011058936B1

(12) United States Patent
Brasch et al.

(10) Patent No.: US 11,058,936 B1
(45) Date of Patent: Jul. 13, 2021

(54) EXERCISE RACK ENCLOSURE SYSTEM

(71) Applicant: PRx Performance, LLC, Fargo, ND (US)

(72) Inventors: Brian B. Brasch, Fargo, ND (US); Garrett A. Iverson, Fargo, ND (US); Jacob M. Yokom, Eagan, MN (US)

(73) Assignee: PRx Performance, LLC, Fargo, ND (US)

( * ) Notice: Subject to any disclaimer, the term of this patent is extended or adjusted under 35 U.S.C. 154(b) by 0 days.

(21) Appl. No.: 17/217,604

(22) Filed: Mar. 30, 2021

(51) Int. Cl.
*A63B 71/04* (2006.01)
*A63B 21/00* (2006.01)
*A63B 21/078* (2006.01)

(52) U.S. Cl.
CPC ..... *A63B 71/04* (2013.01); *A63B 21/078* (2013.01); *A63B 21/4029* (2015.10); *A63B 2210/50* (2013.01)

(58) Field of Classification Search
None
See application file for complete search history.

(56) References Cited

U.S. PATENT DOCUMENTS

| | | | | | |
|---|---|---|---|---|---|
| 332,989 | A | * | 12/1885 | Benedict | A63B 21/0628 482/102 |
| 618,990 | A | | 2/1899 | Lubben | |
| 1,104,505 | A | | 7/1914 | Holworthy | |
| 1,696,145 | A | | 12/1928 | Wagoner | |
| 2,219,219 | A | * | 10/1940 | Boger | A63B 23/00 482/130 |
| 2,632,645 | A | * | 3/1953 | Barkschat | A63B 21/0628 482/38 |
| 2,855,200 | A | | 10/1958 | Blickman | |
| 3,414,262 | A | | 12/1968 | Lounsbury | |
| 3,614,097 | A | | 10/1971 | Blickman | |
| 3,874,657 | A | | 4/1975 | Niebojewski | |
| 3,918,710 | A | | 11/1975 | Niebojewski | |
| 4,249,726 | A | | 2/1981 | Faust | |
| 4,257,590 | A | | 3/1981 | Sullivan | |

(Continued)

FOREIGN PATENT DOCUMENTS

| | | | |
|---|---|---|---|
| CN | 103598759 | A | 2/2014 |
| DE | 4307632 | A1 | 9/1993 |
| GB | 2076299 | A | 12/1981 |
| WO | 2009003280 | A1 | 1/2009 |

OTHER PUBLICATIONS https://www.youtube.com/watch?v=f6bPYbS_2Fw; YouTube Video Equipment Demo Rogue Dirty South Bar; Apr. 25, 2012.

(Continued)

*Primary Examiner* — Joshua Lee
(74) *Attorney, Agent, or Firm* — Neustel Law Offices

(57) ABSTRACT

An exercise rack enclosure system for providing an exercise rack which is concealable within an enclosure. The exercise rack enclosure system generally includes an enclosure including an interior space. An exercise rack is pivotably connected to the enclosure within the interior space. The exercise rack is adjustable between a collapsed position, in which the exercise rack is completely positioned within the interior space of the enclosure, and an extended position, in which the exercise rack extends out of the interior space of the enclosure for use. The enclosure may optionally include one or more doors for concealing the interior space and exercise rack when not in use. Various attachments may be stored in the enclosure and removably connected to the exercise rack for performing a wide range of exercise moves.

30 Claims, 28 Drawing Sheets

(56) References Cited

U.S. PATENT DOCUMENTS 4,262,901 A 4/1981 Faust
4,286,782 A 9/1981 Fuhrhop
4,300,761 A * 11/1981 Howard ..... A63B 17/00 482/130
4,306,715 A 12/1981 Sutherland
4,358,109 A 11/1982 Schrems
4,368,884 A 1/1983 Colvin
4,369,966 A 1/1983 Silberman
4,396,191 A 8/1983 Metler
4,431,181 A * 2/1984 Baswell ..... A63B 21/154 482/102
4,527,797 A 7/1985 Slade, Jr.
4,603,855 A 8/1986 Sebelle
4,615,524 A 10/1986 Sutherland
4,621,809 A 11/1986 Pearl
4,635,934 A 1/1987 Roethke
4,637,608 A 1/1987 Owens
4,645,196 A 2/1987 Christie
4,650,186 A 3/1987 McCreery
4,729,561 A 3/1988 Desjardins
4,757,998 A 7/1988 Landin
4,759,539 A 7/1988 Nieppola
4,765,616 A 8/1988 Wolff
4,773,642 A 9/1988 Cruz
4,781,374 A 11/1988 Lederman
4,795,149 A 1/1989 Pearson
4,804,179 A 2/1989 Murphy
4,826,153 A 5/1989 Schalip
4,842,270 A 6/1989 Lange
4,844,448 A 7/1989 Niznik
4,861,024 A 8/1989 Lee
4,861,025 A 8/1989 Rockwell
4,898,381 A 2/1990 Gordon
4,907,798 A 3/1990 Burchatz
4,915,377 A 4/1990 Malnke
4,919,419 A 4/1990 Houston
4,927,135 A 5/1990 Nieppola
4,928,961 A 5/1990 Madden
4,934,693 A 6/1990 Santoro
4,936,572 A 6/1990 Desiderio
4,955,604 A 9/1990 Pogue
4,958,833 A 9/1990 Stater
4,960,277 A 10/1990 LaRossa
4,974,837 A 12/1990 Someya
4,976,428 A * 12/1990 Ghazi ..... A63B 23/03575 482/112
5,011,141 A 4/1991 Towley, III
5,046,722 A 9/1991 Antoon
5,082,259 A 1/1992 Gonzalez
5,082,260 A 1/1992 Dinelli
5,098,093 A 3/1992 Dupre
5,098,361 A 3/1992 Danylieko
5,141,480 A 8/1992 Lennox
5,151,072 A 9/1992 Cone
5,184,992 A 2/1993 Banks
5,242,345 A 9/1993 Mitchell
5,249,858 A 10/1993 Nusser
5,281,193 A 1/1994 Colbo, Jr.
5,306,220 A 4/1994 Kearney
5,328,428 A 7/1994 Huang
5,346,448 A 9/1994 Sollo
5,350,346 A 9/1994 Martinez
D358,623 S 5/1995 Macasieb
5,456,644 A 10/1995 Hecox
5,466,204 A 11/1995 Nearing
5,509,876 A 4/1996 Reyes
5,551,936 A 9/1996 Parisi
5,669,859 A 9/1997 Liggett
5,688,216 A 11/1997 Mauriello
D390,287 S 2/1998 Hsieh
5,755,823 A 5/1998 Cleary
5,779,601 A 7/1998 Ish, III
5,813,951 A 9/1998 Einsig
D404,443 S * 1/1999 Doyle ..... D21/676
5,882,283 A 3/1999 Stevens
5,921,897 A 7/1999 Stevens
5,964,684 A 10/1999 Sokol
5,971,897 A 10/1999 Olson
6,027,433 A 2/2000 Flynn
6,073,624 A 6/2000 Laurent
6,248,048 B1 6/2001 Zuckerman
6,299,568 B1 10/2001 Prok
6,328,679 B1 12/2001 Croft
6,443,877 B1 9/2002 Hoecht
6,579,213 B1 6/2003 Webber
6,685,601 B1 2/2004 Knapp
7,070,546 B1 7/2006 Grasso
7,338,416 B2 3/2008 Smith
7,374,516 B2 5/2008 Lundquist
7,393,309 B2 7/2008 Webber
7,455,621 B1 11/2008 Anthony
7,488,277 B1 2/2009 Knapp
7,549,950 B1 6/2009 Lundquist
7,575,538 B1 * 8/2009 Clark ..... A63B 23/1263 482/103
7,635,322 B2 12/2009 Parrilla
7,666,118 B1 2/2010 Anthony
7,699,756 B2 4/2010 Piane, Jr.
8,047,972 B1 1/2011 Dean
8,075,454 B2 * 12/2011 Piggins ..... A63B 22/0007 482/62
8,231,509 B2 7/2012 Lundquist
8,491,449 B2 7/2013 Rogers
8,506,459 B2 8/2013 Cassidy
8,517,900 B1 8/2013 Britt
8,651,293 B2 2/2014 Boyer
8,727,953 B2 5/2014 Drechsler
9,192,799 B2 11/2015 Alenaddaf
9,333,387 B2 5/2016 Hopperstad
9,409,048 B1 8/2016 Hopperstad
9,498,670 B1 11/2016 Hopperstad
9,675,510 B2 6/2017 Moerth-Cross
9,713,745 B2 7/2017 Rogers
10,195,479 B2 2/2019 Brasch
10,779,645 B2 * 9/2020 Siaperas ..... A63B 21/4033
10,953,301 B2 3/2021 Brasch
2004/0092369 A1 5/2004 Slawinski
2008/0276551 A1 11/2008 Thomas
2009/0017997 A1 1/2009 Piggins
2009/0143203 A1 6/2009 Knapp
2009/0289535 A1 11/2009 Weber
2010/0048368 A1 2/2010 Donofrio
2011/0195822 A1 8/2011 Donofrio
2012/0289384 A1 11/2012 Staten
2013/0257242 A1 10/2013 Bunch
2014/0018215 A1 1/2014 Donofrio
2014/0031182 A1 1/2014 Donofrio
2014/0243174 A1 8/2014 Alenaddaf
2014/0339184 A1 11/2014 Couch
2015/0148197 A1 5/2015 Lentz
2015/0264823 A1 9/2015 Shirley
2015/0290488 A1 10/2015 Hopperstad
2015/0352395 A1 12/2015 Gregory
2016/0016033 A1 1/2016 Schrag
2016/0074698 A1 * 3/2016 Figueroa ..... A47C 17/38 5/2.1
2017/0065844 A1 3/2017 Hopperstad
2017/0146282 A1 3/2017 Dodge
2017/0197109 A1 7/2017 Cole
2017/0239512 A1 8/2017 Brasch
2018/0178051 A1 6/2018 Shaw, Jr.
2018/0326250 A1 11/2018 Henniger
2019/0240525 A1 8/2019 Leipheimer
2020/0131825 A1 4/2020 Hirtsiefer
2020/0197737 A1 6/2020 Kistner
2020/0384337 A1 12/2020 Brasch

OTHER PUBLICATIONS https://www.roguefitness.com/rogue-r-3w-fold-back-wall-mount-rack; Rogue Fitness R-3W Fold Back Wall Mount Rack Website Page; Jan. 1, 2014.

(56) References Cited

OTHER PUBLICATIONS

2717 Equipment Facebook Posts—W-1 Pull Up and Rack; Nov. 8, 2012.
2717 Equipment Facebook Posts—Wall Mounted Pull Up and Squat Rack; Mar. 27, 2012.
https://www.youtube.com/watch?v=koAzH91o474; YouTube Video Matt Chan Talks the Dirty South Bar; Dec. 20, 2012.
Pictures of PRX Performance Pull-Up Bar on Central Rig Display at Granite Games; Oct. 5, 2013.
http://board.crossfit.com/showthreadphp?t=86058; Pictures from Website for Crossfit Message Board; Feb. 8, 2014.
http://board.crossfit.com/showthread.php?t=86058; Website for Crossfit Message Board; Feb. 8, 2014.
http://www.roguefitness.com/rogue-4-monster-lite-wall-mount, Webpage from Rogue Fitness; Jan. 1, 2014.
http://www.roguefitness.com:80/x-43m-multi-grip-crossmember.php; Rogue Fitness X-43 Multi-Grip Crossmember Website Page; Jan. 23, 2013.
http://www.roguefitness.com:80/w4-garage-gym.php; Rogue Fitness W-4 Garage Gym Website Page; Jan. 23, 2013.
http://www.roguefitness.com:80/rogue-sm-2-monster-squat-stand.php; Rogue Fitness SM-2 Monster Squat Stand Website Page; Jan. 27, 2013.
http://www.roguefitness.com:80/rogue-r-3-power-rack.php; Rogue Fitness R3 Power Rack Website Page; Jan. 11, 2013.
http://www.roguefitness.com:80/bodyweight-gymnastics/rpg-pullup-system.php; Rogue Fitness Pull Up & RPG Systems Website Page; Jan. 23, 2013.
http://www.roguefitness.com:80/dirty-south-bar.php; Rogue Fitness Dirty South Bar Website Page; Jan. 23, 2013.

* cited by examiner

EXERCISE RACK ENCLOSURE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to an exercise rack enclosure system for providing an exercise rack which is concealable within an enclosure.

Related Art

Any discussion of the related art throughout the specification should in no way be considered as an admission that such related art is widely known or forms part of common general knowledge in the field.

More and more people are looking to stay fit, particularly during times of quarantine and self-isolation. While exercise studios have become ubiquitous in modern life, constraints such as time, distance of travel, and health crises have caused more and more people to seek out exercise equipment to use in their own homes.

Home exercise equipment is widely available, including various exercise racks, exercise bikes, rowing machines, reformers, and the like. However, such exercise equipment can be unsightly, particularly when positioned in a space of the home which visitors frequent such as a living room. Additionally, such exercise equipment can require a lot of space and leave various structures which can create a mess and heighten the risk of injury, such as from a child tripping over weights or an exercise rack.

While such exercise equipment is suitable for performing exercises, it would be far more preferable to utilize exercise equipment which may be easily concealed from view when not in use and which may be neatly stored without any devices or structures laying around to be tripped over.

SUMMARY

An example embodiment is directed to an exercise rack enclosure system. An example embodiment of the exercise rack enclosure system generally includes an enclosure including an interior space. An exercise rack is pivotably connected to the enclosure within the interior space. The exercise rack is adjustable between a collapsed position, in which the exercise rack is completely positioned within the interior space of the enclosure, and an extended position, in which the exercise rack extends out of the interior space of the enclosure for use. The enclosure may optionally include one or more doors for concealing the interior space and exercise rack when not in use. Various attachments may be stored in the enclosure and removably connected to the exercise rack for performing a wide range of exercise moves.

There has thus been outlined, rather broadly, some of the embodiments of the exercise rack enclosure system in order that the detailed description thereof may be better understood, and in order that the present contribution to the art may be better appreciated. There are additional embodiments of the exercise rack enclosure system that will be described hereinafter and that will form the subject matter of the claims appended hereto. In this respect, before explaining at least one embodiment of the exercise rack enclosure system in detail, it is to be understood that the exercise rack enclosure system is not limited in its application to the details of construction or to the arrangements of the components set forth in the following description or illustrated in the drawings. The exercise rack enclosure system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
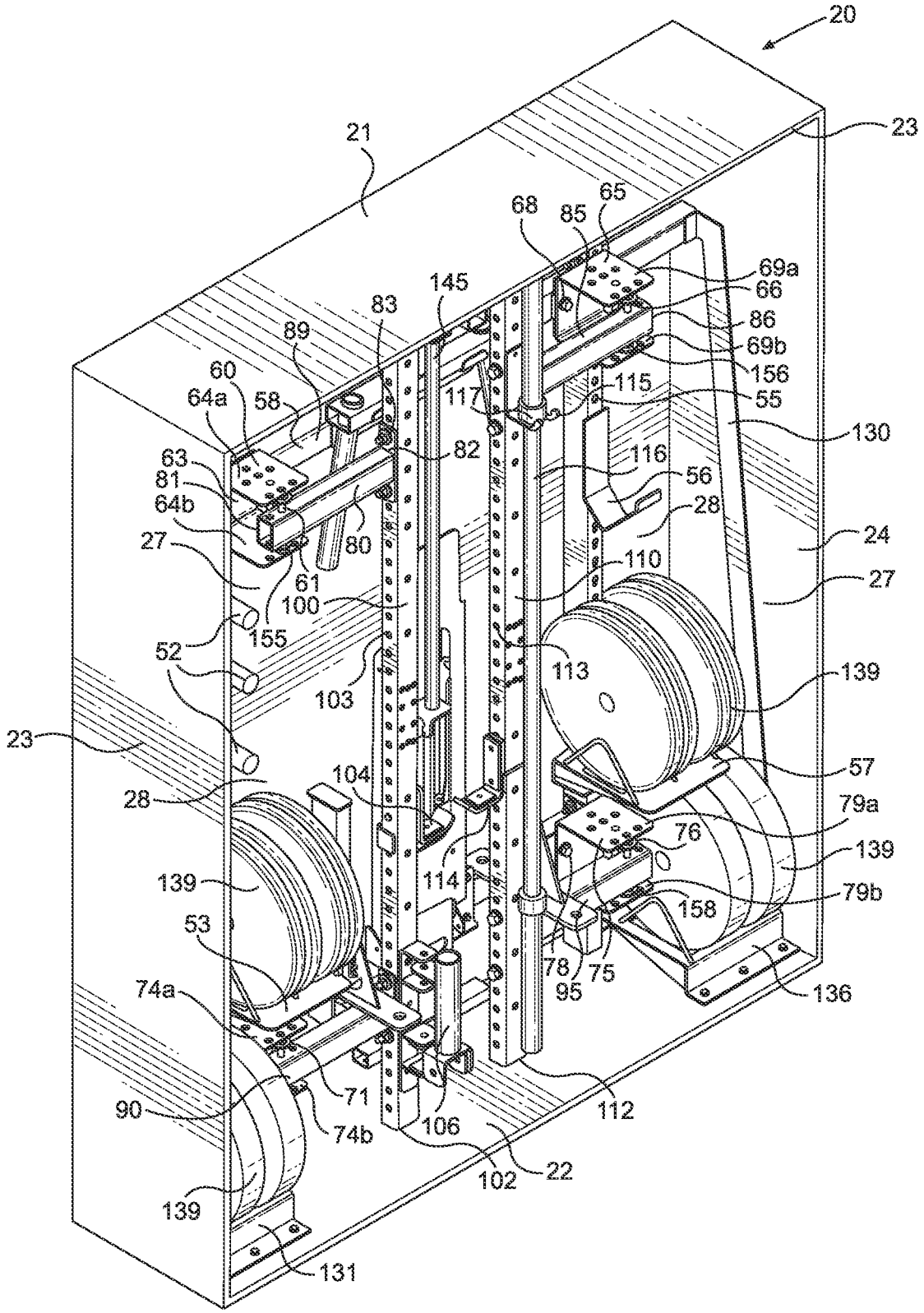
FIG. 1 is a perspective view of an exercise rack enclosure system with the exercise rack in a collapsed position in accordance with an example embodiment.

An example embodiment of the exercise rack enclosure system generally comprises an enclosure 20 including a ceiling 21, a floor 22, a rear wall 24, a first sidewall 25, and a second sidewall 26. The ceiling 21 is connected to the rear wall 24, the first sidewall 25, and the second sidewall 26. The floor 22 is connected to the rear wall 24, the first sidewall 25, and the second sidewall 26. The rear wall 24 is connected to the floor 22, the ceiling 21, the first sidewall 25, and the second sidewall 26. The enclosure 20 includes a front opening 27 and the enclosure 20 includes an interior space 28 accessible through the front opening 27. At least one door 30, 35 is pivotably connected to the enclosure 20, with the at least one door 30, 35 being adapted to selectively enclose the front opening 27. A frame 89 is attached to the rear wall 24 of the enclosure 20. An exercise rack 99 is pivotably connected to the frame 89. The exercise rack 99 is adjustable between a collapsed position in which the exercise rack 99 is completely within the interior space 28 of the enclosure 20 and an extended position in which a portion of the exercise rack 99 extends outwardly from the enclosure 20 through the front opening 27.

The exercise rack 99 is pivotably connected to the frame 89 by at least one hinge 61, 66, 71, 76, with the exercise rack 99 being adapted to pivot about a vertical axis extending through the at least one hinge 61, 66, 71, 76 and the exercise rack 99 being adapted to slide upwardly and downwardly along the vertical axis extending through the at least one hinge 61, 66, 71, 76. The exercise rack 99 is oriented parallel to the rear wall 24 of the enclosure 20 when the exercise rack 99 is in the collapsed position and oriented perpendicular to the rear wall 24 of the enclosure 20 when the exercise rack 99 is in the extended position. The exercise rack 99 is vertically adjustable between a raised position and a lowered position. A lower end 102, 112 of the exercise rack 99 is adapted to rest upon the floor 22 of the enclosure 20 when the exercise rack 99 is in the raised position. The lower end 102, 112 of the exercise rack 99 is adapted to rest upon a surface underlying the enclosure 20 when the exercise rack is in the lowered position.

The at least one door 30, 35 is comprised of a first door 30 pivotably connected to a first side of the enclosure 20 and a second door 35 pivotably connected to a second side of the enclosure 20. The first door 30 is comprised of a first segment 31 and a second segment 32 pivotably connected to the first segment 31 and the second door 35 is comprised of a third segment 36 and a fourth segment 37 pivotably connected to the third segment 36.

A platform 40 is pivotably connected to the floor 22 of the enclosure 20, with the platform 40 being adjustable between a raised position in which the platform 40 is completely within the interior space 28 of the enclosure 20 and a lowered position in which a portion of the platform 40 extends outwardly from the enclosure 20. The exercise rack 99 is adapted to rest upon the platform 40 when the exercise rack 99 is in the extended position and the platform 40 is in the lowered position.

A bench 120 is pivotably connected to the rear wall 24 of the enclosure 20, with the bench 120 being adjustable between a first position in which the bench 120 is secured against the rear wall 24 of the enclosure 20 and a second position in which the bench 120 at least partially extends out of the front opening 27 of the enclosure 20.

The frame 89 is comprised of a first support member 50 and a second support member 54 and the exercise rack 99 is comprised of a first rack member 100 and a second rack member 110. The first rack member 100 is pivotably connected to the first support member 50 by a first hinge 61 and the second rack member 110 is pivotably connected to the second support member 54 by a second hinge 66. The first rack member 100 is adapted to swing towards the second rack member 110 and wherein the second rack member 110 is adapted to swing towards the first rack member 100. The first rack member 100 and the second rack member 110 are each vertically adjustable between a raised position and a lowered position.

The frame 89 includes a cross support member 59 connected to the rear wall 24 between the first support member 50 and the second support member 54, and a bench 120 pivotably connected to the cross support member 59. A first spotter arm 109 is pivotably connected to the cross support member 59 on a first side of the bench 120 and a second spotter arm 119 is pivotably connected to the cross support member 59 on a second side of the bench 120.

A platform 40 is pivotably connected to the floor 22 of the enclosure 20, with the platform 40 being pivotably adjustable between a raised position and a lowered position. The first rack member 100 and the second rack member 110 are each adapted to rest upon the platform 40 when the platform 40 is in the lowered position and the exercise rack 99 is in the extended position.

A first weight support 131 is connected to the floor 22 of the enclosure 20 between the first support member 50 and the first sidewall 25 and a second weight support 136 is connected to the floor 22 of the enclosure 20 between the second support member 54 and the second sidewall 26. The first weight support and the second weight support 136 are each adapted to support one or more weights 139.

Another exemplary embodiment of an exercise rack enclosure system generally comprises an enclosure 20 including a ceiling 21, a floor 22, a rear wall 24, a first sidewall 25, and a second sidewall 26. The ceiling 21 is connected to the rear wall 24, the first sidewall 25, and the second sidewall 26. The floor 22 is connected to the rear wall 24, the first sidewall 25, and the second sidewall 26. The rear wall 24 is connected to the floor 22, the ceiling 21, the first sidewall 25, and the second sidewall 26. The enclosure 20 includes a front opening 27 and the enclosure 20 includes an interior space 28 accessible through the front opening 27. At least one door 30, 35 is pivotably connected to the enclosure 20, with the at least one door 30, 35 being adapted to selectively enclose the front opening 27.

A first side support member 50 is attached to the rear wall 24 of the enclosure 20. A first upper hinge 61 is connected to the first side support member 50 at or near an upper end of the first side support member 50. A first lower hinge 71 connected to the first side support member 50 at or near a lower end of the first side support member 50. A second side support member 54 is attached to the rear wall 24 of the enclosure 20. A second upper hinge 66 is connected to the second side support member 54 at or near an upper end of the second side support member 54. A second lower hinge 76 is connected to the second side support member 54 at or near a lower end of the second side support member 54.

The exercise rack enclosure system generally includes an exercise rack 99 including a first rack member 100 and a second rack member 110, with the first rack member 100 being pivotably connected to the first upper hinge 61 by a first upper linkage 80 and the first rack member 100 being pivotably connected to the first lower hinge 71 by a first lower linkage 90. The first upper linkage 80 is vertically adjustable with respect to the first upper hinge 61, and the first lower linkage 90 is vertically adjustable with respect to the first lower hinge 71. The second rack member 110 is pivotably connected to the second upper hinge 66 by a second upper linkage 85 and pivotably connected to the second lower hinge 76 by a second lower linkage 95. The second upper linkage 85 is vertically adjustable with respect to the second upper hinge 66 and the second lower linkage 95 is vertically adjustable with respect to the second lower hinge 76. The first rack member 100 is adapted to swing towards and away from the second rack member 110 and the second rack member 110 is adapted to swing towards and away from the first rack member 100.

The exercise rack 99 is adjustable between a collapsed position in which the first rack member 100 and the second rack member 110 are each completely within the interior space 28 of the enclosure 20 and an extended position in which the first rack member 100 and the second rack member 110 each extend outwardly from the enclosure 20 through the front opening 27. The exercise rack is vertically adjustable between a raised position and a lowered position. A lower end 101, 111 of the exercise rack 99 is adapted to rest upon the floor 22 of the enclosure 20 when the exercise rack 99 is in the raised position and the lower end 102, 112 of the exercise rack 99 is adapted to rest upon a surface underlying the enclosure 20 when the exercise rack 99 is in the lowered position.

B. Enclosure

As best shown in FIGS. 1-4, 6-9, and 12-25, the exercise rack enclosure system may include an enclosure 20 which is adapted to enclose and conceal an exercise rack 99 when the exercise rack 99 is not in use. The shape, size, orientation of the enclosure 20 may vary in different embodiments, and thus should not be construed as limited by the exemplary embodiments shown in the figures. The enclosure 20 may be upright and freestanding such as shown in FIGS. 1-10B. Although the enclosure 20 is generally not connected to any wall or similar surface, the enclosure 20 may in some embodiments be anchored to a wall or similar surface to prevent the enclosure 20 from toppling over, such as during an earthquake.

Figure 2:
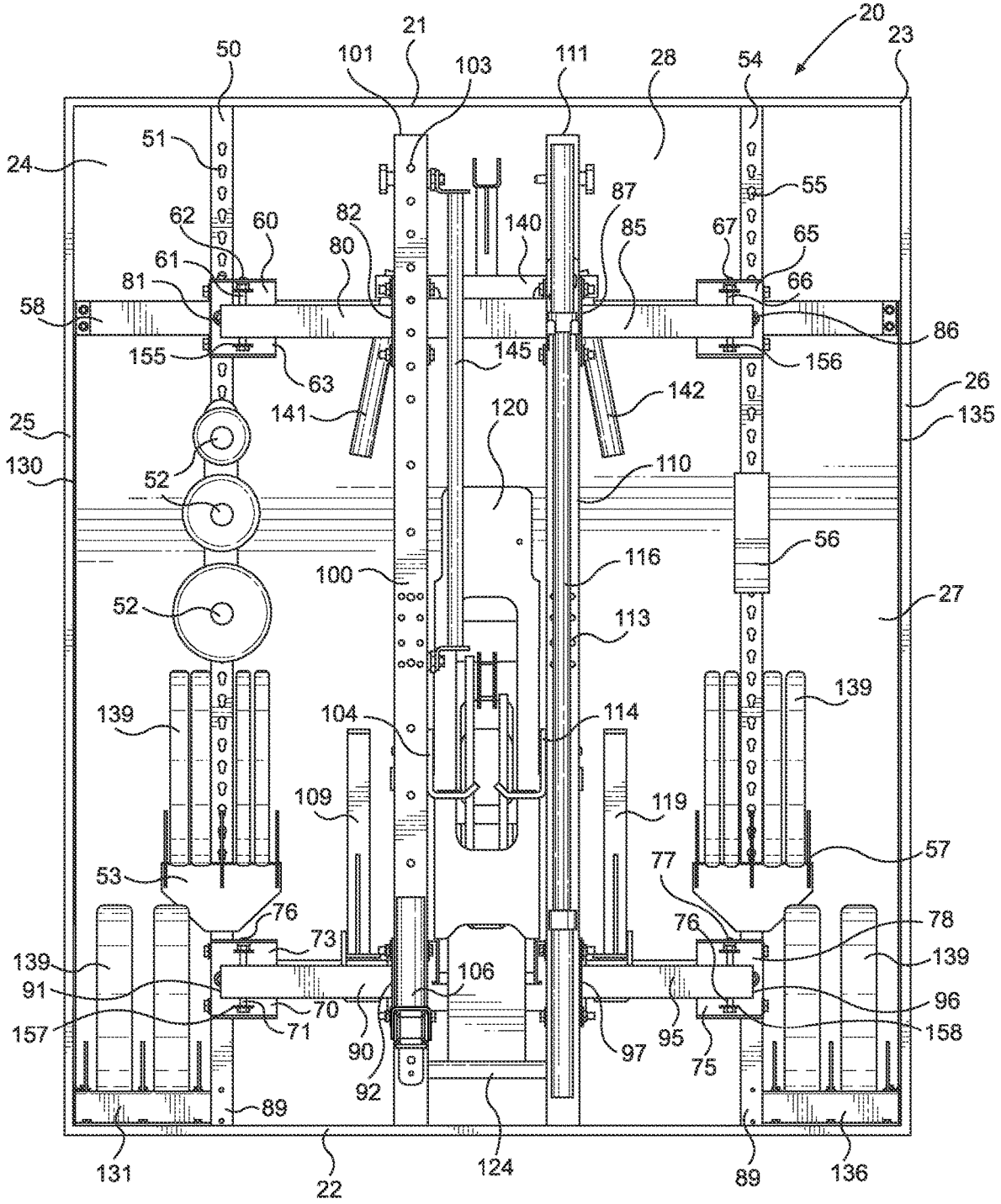
FIG. 2 is a front view of an exercise rack enclosure system with the exercise rack in a collapsed position in accordance with an example embodiment.

In the exemplary embodiment best shown in FIGS. 1 and 2, the enclosure 20 is illustrated as being comprised of a ceiling 21, a floor 22, a front end 23, a rear wall 24, a first sidewall 25, and a second sidewall 26. The ceiling 21 of the enclosure 20 may be connected to the rear wall 24, the first sidewall 25, and the second sidewall 26. The floor 22 of the enclosure 20 may be connected to the rear wall 24, the first sidewall 25, and the second sidewall 26. The rear wall 24 of the enclosure 20 may be connected to the ceiling 21, the floor 22, the first sidewall 25, and the second sidewall 26. The first sidewall 25 of the enclosure 20 may be connected to the ceiling 21, the floor 22, and the rear wall 24. The second sidewall 25 of the enclosure 20 may be connected to the ceiling 21, the floor 22, and the rear wall 24.

As best shown in FIGS. 1 and 2, the enclosure 20 may include a front opening 27 at its front end 23 through which the exercise rack 99 may be extended or retracted, with the interior space 28 of the enclosure 20 being accessible through the front opening 27. The front opening 27 of the enclosure 20 may be defined by the ceiling 21, the floor 22, the first sidewall 25, and the second sidewall 26. However, in some embodiments, the front opening 27 may be inset with respect to any or all of the ceiling 21, the floor 22, the first sidewall 25, and the second sidewall 26, such as in embodiments in which various types of trims are utilized.

The enclosure 20 will generally include an interior space 28 in which the exercise rack 99 may be stored when not in use, and out of which the exercise rack 99 extends when in use. The interior space 28 may be defined by the ceiling 21, the floor 22, the rear wall 24, the first sidewall 25, and the second sidewall 26. The size of the interior space 28 may vary in different embodiments depending upon the exercise rack 99 and any other accessories being stored therein. FIGS. 6-10B and 17-21 illustrate a smaller enclosure 20 including a smaller interior space 28 and FIGS. 1-5B and 12-16 illustrate a larger enclosure 20 including a larger interior space 28.

As discussed in more detail herein, an exercise rack 99 is generally positioned within and connected to the enclosure 20 such that the exercise rack 99 may be collapsed or folded into the interior space 28 when the exercise rack 99 is not in use, or extended at least partially out of the interior space 28 when the exercise rack 99 is in use. The exercise rack 99 may include an exposed front opening 27 (e.g., omitting a door 30, 35) or may include one or more doors 30 which are adapted to selectively enclose and cover the front opening 27 when the exercise rack 99 is not in use.

The figures illustrate a substantially box-shaped enclosure 20 with rectangular faces. It should be appreciated, however, that various other shapes may be utilized for the enclosure 20. The enclosure 20 may be shaped and sized so as to resemble a various types of furniture, such as but not limited to a hutch, cabinet, chest, dresser, bookcase, wardrobe (e.g., armoire), or the like. In this manner, the enclosure 20 may be positioned in the living space of a home or in an office environment without being immediately recognized as exercise equipment.

The enclosure 20 may include at least one door 30 which is movably connected to the enclosure 20 to selectively enclose the interior space 28 and at least partially cover the front opening 27. In some embodiments, such as shown in FIGS. 1-10B, a door 30 may be omitted entirely, with the front opening 27 and interior space 28 being exposed even when the exercise rack 99 is collapsed within the interior space 28 and not in use. In other embodiments, such as shown in FIGS. 12-25, one or more doors 30 may be utilized.

In an exemplary embodiment, a single door 30 may be utilized. The door 30 may be pivotably connected to the enclosure 20 and may be adapted to swing side-to-side or up-and-down. As one example, a single door 30 may be pivotably connected to the first sidewall 25 of the enclosure 20 and swing side-to-side. As a further example, the single door 30 may be pivotably connected to the floor 22 of the enclosure 20 and swing up-and-down. Various other configurations should be utilized, and the exemplary embodiments shown in the figures should not be construed as limiting with respect to the positioning, orientation, movement, configuration, shape, or size of the door(s) 30, 35.

In the embodiment best shown in FIGS. 12-25, the enclosure 20 includes a double door including a pair of doors 30, 35 which function together to selectively enclose the opening 27 and interior space 28 of the enclosure 20. Generally, a first door 30 will be pivotably connected to a first side of the enclosure 20, such as to the first sidewall 25 of the enclosure 20. A second door 35 is pivotably connected to a second side of the enclosure 20, such as to the second sidewall 26 of the enclosure 20. The first and second doors 30, 35 meet at the approximate mid-point between the first and second sidewalls 25, 26 and may be secured together when closed using various methods known in the art.

Figure 13:
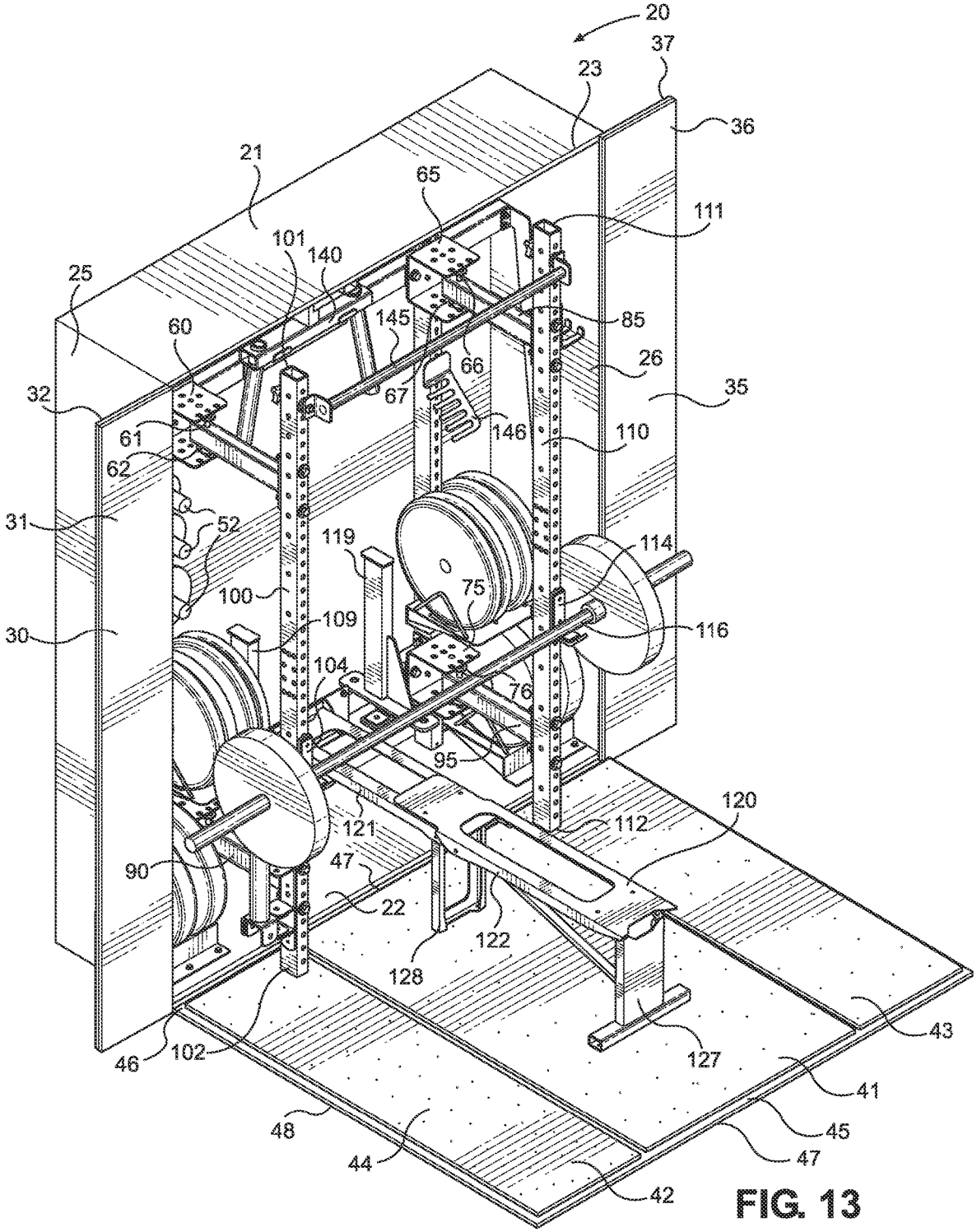
FIG. 13 is a perspective view of an exercise rack enclosure system with the doors opened and the platform lowered in accordance with an example embodiment.
Figure 15:
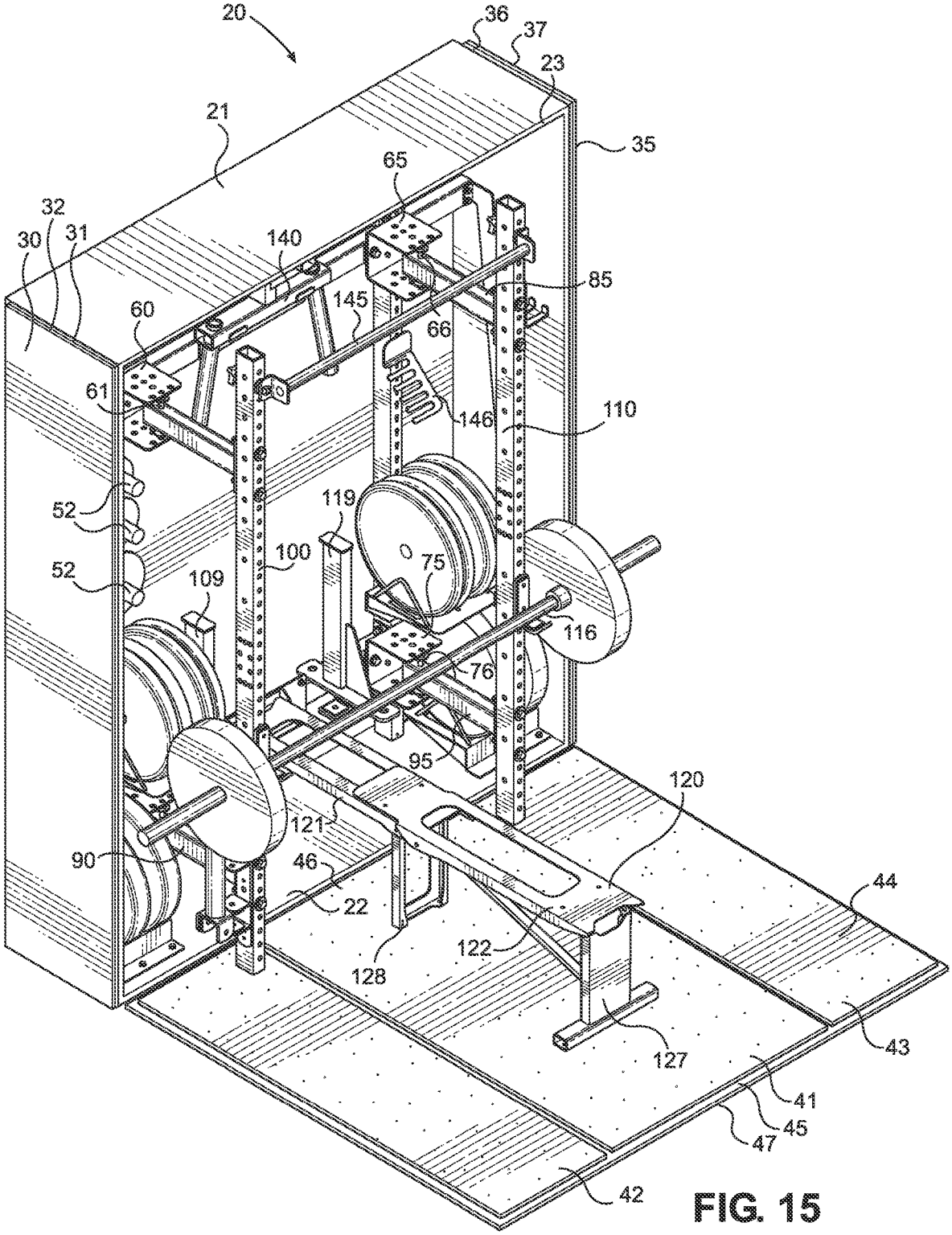
FIG. 15 is a perspective view of an exercise rack enclosure system with the doors opened and folded against the enclosure and the platform lowered in accordance with an example embodiment.

As best shown in FIGS. 13 and 15, the doors 30, 35 may be comprised of folding, segmented doors 30, 35 such that each door 30, 35 may be folded against itself. In the exemplary embodiment shown in the figures, the first door 30 is shown as comprising a first segment 31 and a second segment 32. The first segment 31 is pivotably connected to a first side of the enclosure 20, such as to the first sidewall 25. The second segment 32 is pivotably connected to the first segment 31 such that the second segment 32 may fold against the first segment 31 as shown in FIG. 13.

Continuing to reference FIGS. 13 and 15, it can be seen that the second door 35 may comprise a third segment 36 and a fourth segment 37. The third segment 36 is pivotably connected to a second side of the enclosure 20, such as to the second sidewall 26. The fourth segment 37 is pivotably connected to the third segment 36 such that the fourth segment 37 may fold against the third segment 36 as shown in FIG. 13.

In the exemplary embodiment shown in the figures, the doors 30, 35 are opened and folded against themselves, with the first door 30 being perpendicular to the first sidewall 25 and the second door 35 being perpendicular to the second sidewall 26 when both doors 30, 35 are opened. However, in some embodiments, the doors 30, 35 may further fold to rest against the outer sides of the enclosure 20, with the first door 30 being parallel to the first sidewall 25 and the second door 35 being parallel to the second sidewall 26.

As shown in FIGS. 13-16 and 18-25, the enclosure 20 may include a platform 40 which is pivotably connected to the enclosure 20 such that the platform 40 may be adjusted between a raised position in which the platform 40 is completely within the interior space 28 of the enclosure 20 and a lowered position in which a portion of the platform 40 extends outwardly from the enclosure 20. The platform 40 may function as a floor mat for the exercise rack 99 to rest upon when the exercise rack 99 is in the extended position. In this manner, damage to the exercise rack 99 from repeated contact with a hard floor may be prevented, and damage to the floor from repeated contact with the exercise rack 99 may also be prevented.

It should be appreciated that the platform 40 may be utilized by itself without any separate door(s) 30, 35. In such an embodiment, the platform 40 may function to partially or fully enclose the opening 27 and interior space 28 of the enclosure 20 without any separate door(s) 30, 35 being utilized. In other embodiments, the door(s) 30, 35 and/or platform 40 may be omitted entirely.

In the exemplary embodiment shown in FIGS. 13-25, the platform 40 is used in combination with a pair of doors 30, 35, with the platform 40 being positioned upright or substantially upright behind the doors 30, 35 when the platform 40 is in the raised position and the doors 30, 35 are closed. Thus, the platform 40 may be adapted to rest on the inside of the doors 30, 35 when the platform 40 is folded inwardly and vertically. In some embodiments, the platform 40 may be separately connected to the enclosure when in its raised position, such as with a bracket, clamp, fastener, magnets, adhesives, or the like.

The shape, size, orientation, configuration, and positioning of the platform 40 may vary in different embodiments and should not be construed as limited by the exemplary figures. The platform 40 will generally be comprised of a first end 46, a second end 47, a first side 48, and a second side 49. The first end 46 of the platform 40 will generally be pivotably connected to the enclosure 20, such as to the front end 23 of the enclosure 20 as shown in the figures.

As shown in FIGS. 22-25, the platform 40 may be adapted to fold onto itself such that the effective width of the platform 40 may be reduced to fit through the opening 27 of the enclosure 20. In this manner, a platform 40 which is wider than the enclosure 20 itself may be utilized in some embodiments.

Figure 20:
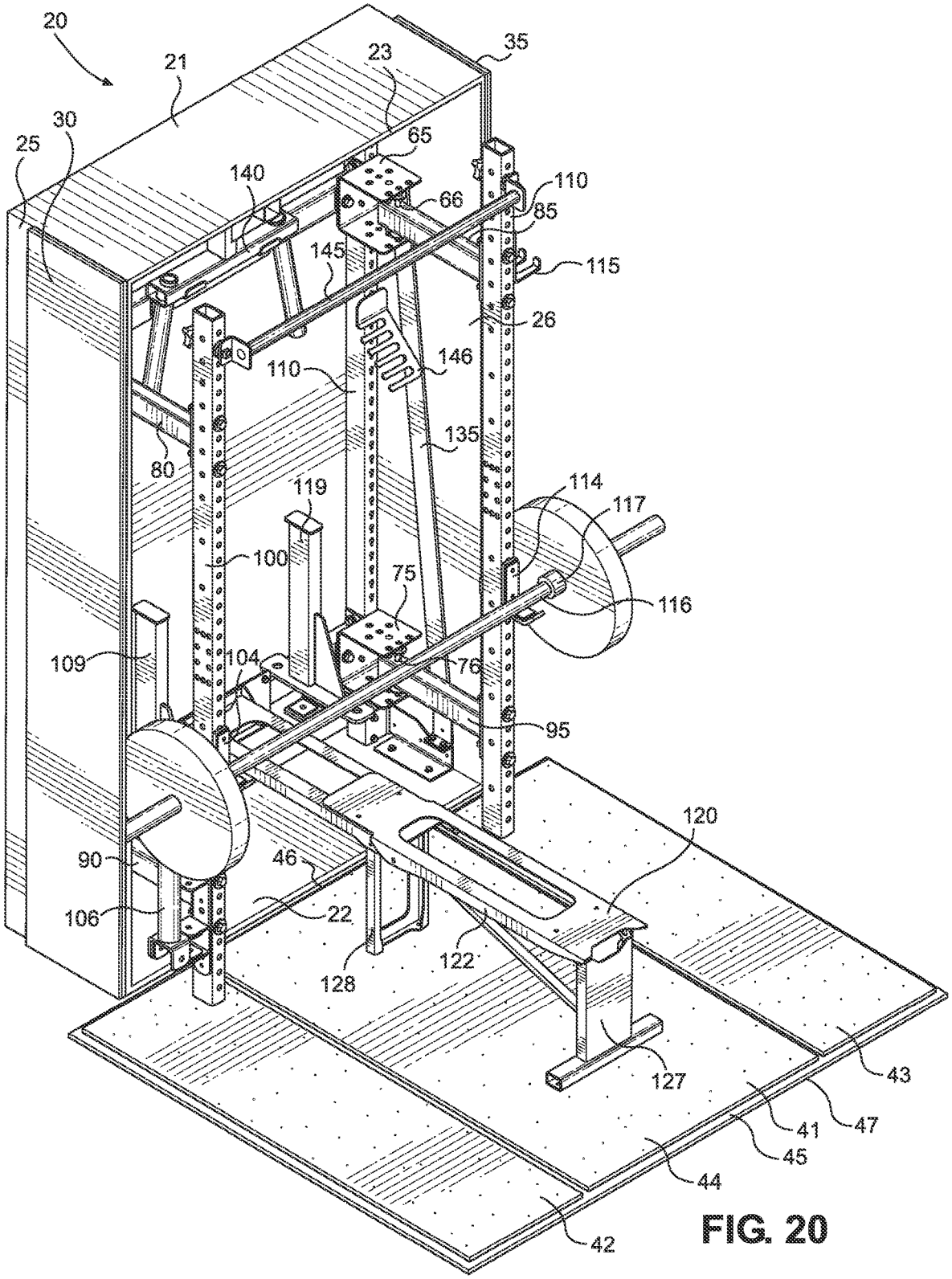
FIG. 20 is a perspective view of an exercise rack enclosure system with the doors opened and folded against the enclosure and the platform lowered in accordance with an example embodiment.

FIG. 20 illustrates an exemplary embodiment of the platform 40 in which the platform 40 includes a central segment 41, a first side segment 42 pivotably connected to a first side of the central segment 41, and a second side segment 43 pivotably connected to a second side of the central segment 41. The first side segment 42 thus forms the first side 48 of the platform 40 and the second side segment 43 thus forms the second side 49 of the platform 40 when the platform 40 is unfolded. The first and second side segments 42, 43 may fold towards each other onto the central segment 41 prior to the platform 40 being raised into the interior space 28.

Figure 24:
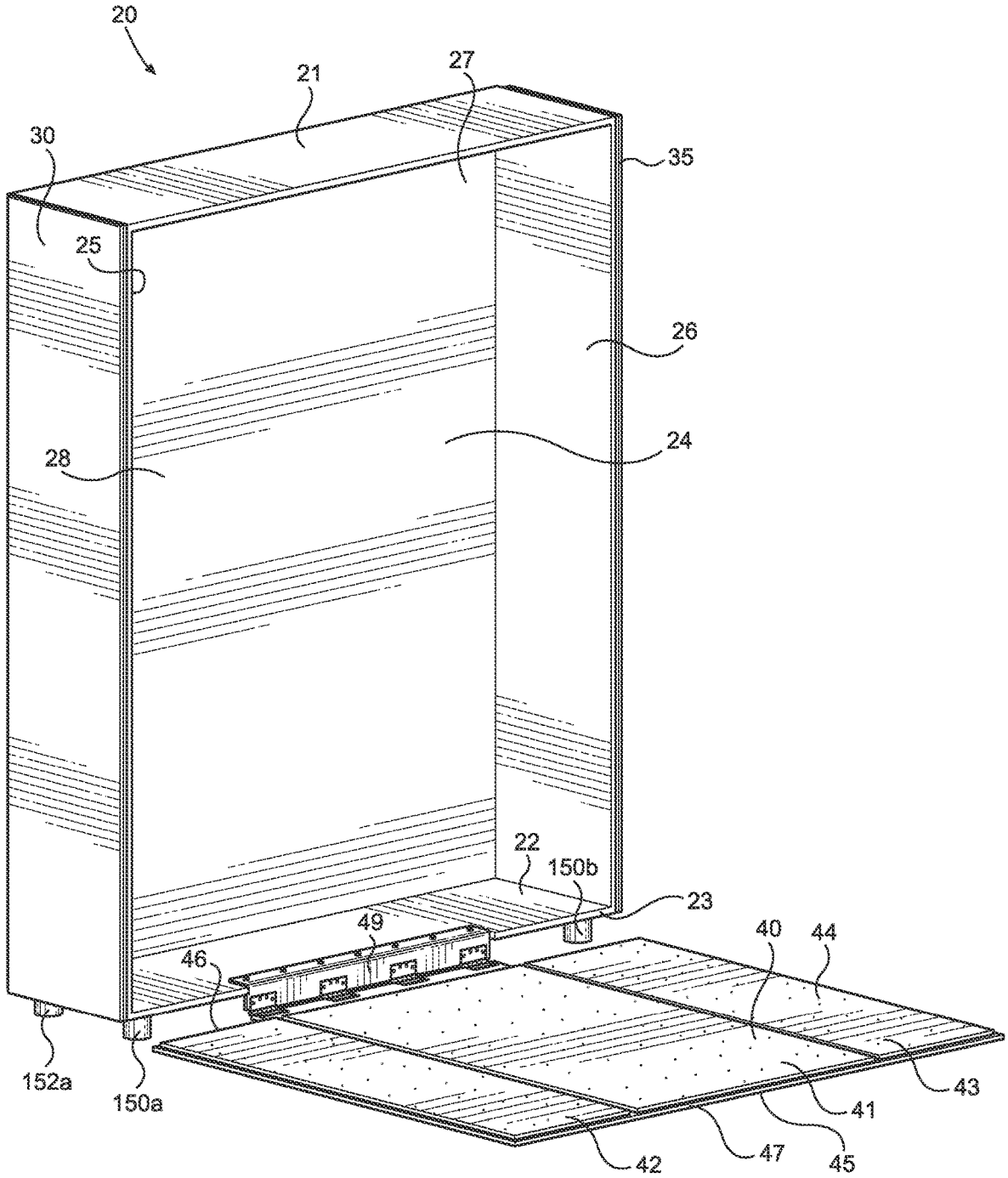
FIG. 24 is a perspective view of an exercise rack enclosure system with the doors opened and the platform lowered in accordance with an example embodiment.

As shown in FIGS. 22-25, the platform 40 may be pivotably connected to the front end 23 of the enclosure 20 by a platform hinge 79. The platform hinge 79 may be connected between the floor 22 of the enclosure 20 and the first end 46 of the platform 40 as shown in FIG. 24. The platform hinge 79 may extend for the full length between the first and second sides 48, 49 of the platform 40, or may be shorter in length and thus inset with respect to the first and second sides 48, 49 of the platform 40. Various types of hinges may be utilized for the platform hinge 79. Additionally, any other method known in the art for pivotably connecting a pair of objects together may be utilized in different embodiments.

Figure 25:
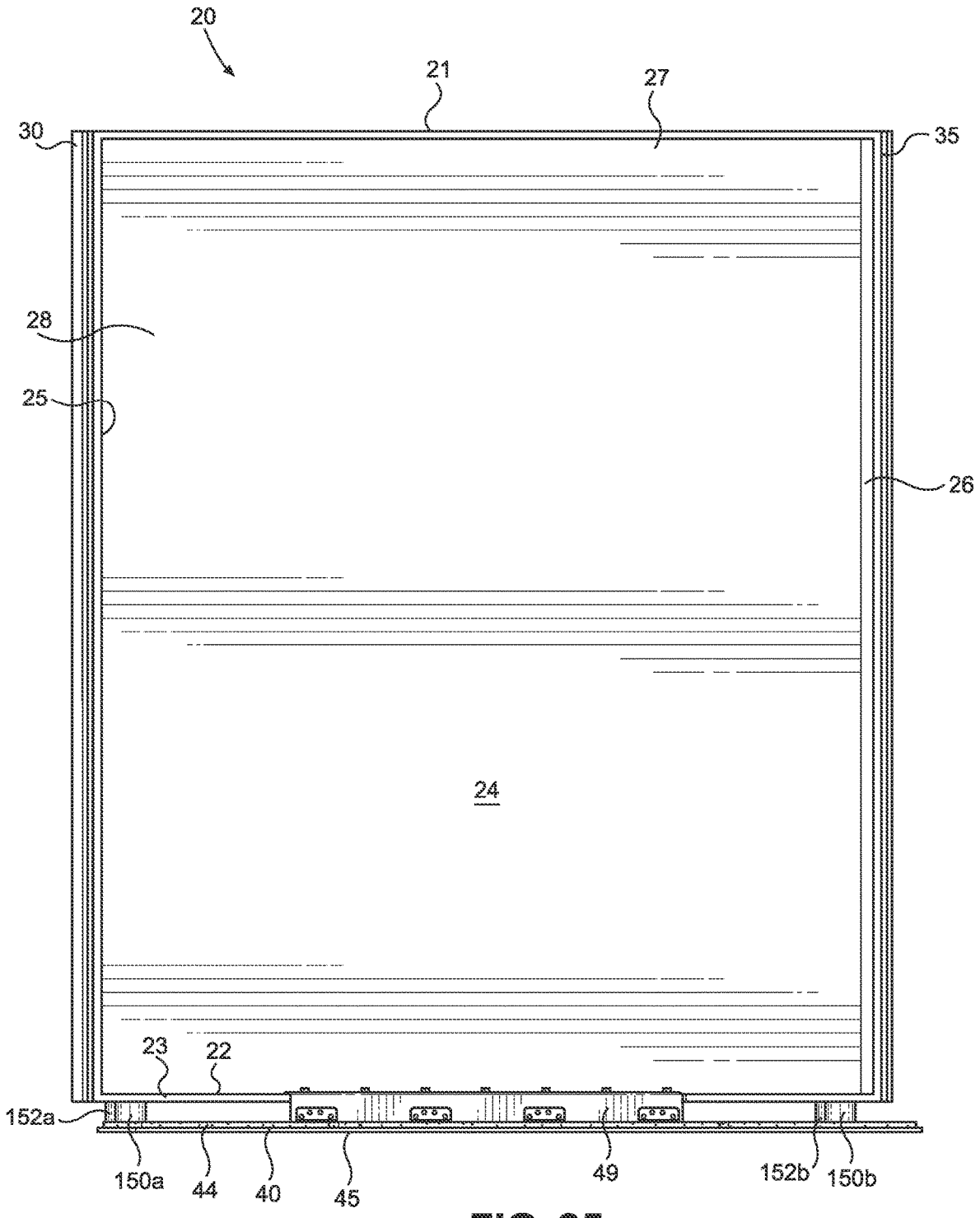
FIG. 25 is a front view of an exercise rack enclosure system with the doors opened and the platform lowered in accordance with an example embodiment.

As best shown in FIGS. 24 and 25, the platform 40 may comprise multiple layers 44, 45. In the embodiment shown in FIG. 24, the platform 40 is shown as comprising an upper layer 44 and a lower layer 45. The upper layer 44 of the platform 40 may comprise a malleable material such as rubber, plastic, or the like which is meant not to damage, or be damaged by, repeated contact from the exercise rack 99. The lower layer 45 may comprise wood, metals, or other materials meant to have a more aesthetic appearance when the platform 40 is in the raised position and thus the lower layer 45 faces outwardly. In some embodiments, only a single layer may be utilized, with the entire thickness of the platform 40 being comprised of a single material such as rubber, plastic, metal, alloys, wood, or the like.

As best shown in FIGS. 22-25, the enclosure 20 may include a plurality of legs 150*a*, 150*b*, 152*a*, 152*b* which extend downwardly from a lower end of the enclosure 20 to raise the enclosure 20 above the floor 15. The positioning, orientation, shape, size, configuration, and number of legs 150*a*, 150*b*, 152*a*, 152*b* may vary in different embodiments, and thus should not be construed as limited by the exemplary figures.

In the exemplary embodiment best shown in FIGS. 22-25, it can be seen that the enclosure 20 is disclosed as including four legs 150*a*, 150*b*, 152*a*, 152*b*. More specifically, a first front leg 150*a* is positioned near the front end 23 and first sidewall 25 of the enclosure 20, a second front leg 150*b* is positioned near the front end 23 and second sidewall 26 of the enclosure 20, a first rear leg 152*a* is positioned near the rear wall 24 and first sidewall 25 of the enclosure 20, a second rear leg 152*b* is positioned near the rear wall 24 and second sidewall 26 of the enclosure 20. Such a configuration allows the enclosure 20 to stand upright, slightly raised from the underlying floor 15 on which the enclosure 20 rests.

In embodiments in which the enclosure 20 is raised off the floor 15, the connectors 60, 65, 70, 75 may be configured to vertically adjust so that the exercise rack 99 may lower itself to contact the underlying floor 15 on which the enclosure 20 is positioned so that the exercise rack 99 is horizontally-levelled. In other embodiments where a platform 40 is utilized, the platform 40 may be of sufficient thickness that the platform 40 is level with the floor 22 of the enclosure 20 such that vertical adjustment of the exercise rack 99 may not be necessary for a levelled orientation.

C. Support Frame

As best shown in FIGS. 1-4, the exercise rack enclosure system may include a frame 89 which is connected to the enclosure 20 within the interior space 28, with the exercise rack 99 being pivotably connected to the support frame 89. The support frame 89 is utilized to provide structure support for the weight of the exercise rack 99 when in both its extended and collapsed positions. However, it should be appreciated that, in some embodiments, the support frame 89 may be omitted, with the exercise rack 99 instead being connected directly to the enclosure 20.

In the embodiment shown in FIGS. 1-4, the support frame 89 is connected to the rear wall 24 of the enclosure 20. However, the support frame 89 may alternatively or additionally be connected to various other portions of the enclosure 20 within the interior space 28, such as to the ceiling 21, floor 22, first sidewall 25, and/or second sidewall 26. The manner in which the support frame 89 is connected to the enclosure 20 may vary in different embodiments, including but not limited to the use of fasteners, adhesives, magnets, brackets, clamps, and the like.

As best shown in FIGS. 1-4, the support frame 89 is shown as comprising a first side support member 50, a second side support member 54, a first cross support member 58, and a second cross support member 59. The positioning of the respective support members 50, 54, 58, 59 may vary in different embodiments. For example, in the exemplary embodiments illustrated in FIGS. 6-9, in which the enclosure is narrower, the first and second side support members 50, 54 may be positioned adjacent to the first and second sidewalls 25, 26. In the exemplary embodiments illustrated in FIGS. 1-4, in which the enclosure 20 is wider, the first and second side support members 50, 54 may be more inset with respect to the first and second sidewalls 25, 26 to permit room for weight supports 131, 136 to be positioned between the first and second side support members 50, 54 and the first and second sidewalls 25, 26, respectively.

As best shown in FIGS. 2, 4, 7, and 9, the first and second side support members 50, 54 may each comprise an elongated member which extends vertically or substantially vertically between the ceiling 21 and the floor 22 of the interior space 28 of the enclosure 20. In some embodiments, the first and second side support members 50, 54 may extend the entire length between the ceiling 21 and the floor 22. In other embodiments, the first and second side support members 50, 54 may only extend for part of the length between the ceiling 21 and the floor 22.

With reference to FIGS. 2, 4, 7, and 9, it can be seen that the first side support member 50 includes a plurality of openings 51 extending along its length, and that the second side support member 54 includes a plurality of openings 55 extending along its length. The shape, size, spacing, orientation, positioning, and number of openings 51, 55 extending along the respective first and second side support members 50, 54 may vary in different embodiments. The openings 51, 55 may extend along one or more faces of the first and second side support members 50, 54. The openings 51, 55 may be circular, oval-shaped, or keyhole-shaped such as shown in the figures. The openings 51, 55 are utilized to removably attach various attachments, such as but not limited to a weight retainer attachment 52 and/or hook bracket 56, to one or both of the first and second side support members 50, 54.

In the embodiment best shown in FIGS. 2, 4, 7, and 9, a first side support member 50 is attached to the rear wall 24 of the enclosure 20 and a second side support member 54 is attached to the rear wall 24 of the enclosure 20, with the first and second side support members 50, 54 both extending vertically in parallel orientation between the floor 22 and the ceiling of the enclosure 20. A first cross support member 58 is attached to the rear wall 24 of the enclosure 20 and a second cross support member 59 is attached to the rear wall 24 of the enclosure 20, with the first and second cross support members 58, 59 each extending horizontally in parallel orientation between the first side support member 50 and the second side support member 54. It should be appreciated that additional support members, including but not limited to additional vertical, horizontal, or diagonal support members, may be included as part of the support frame 89 in some embodiments.

As best shown in FIG. 2, the first side support member 50 may include a weight retainer attachment 52 which is removably or fixedly attached to the first side support member 50. In the embodiment shown in the figures, the weight retainer attachment 52 is shown as comprising three elongated members such as rods on which one or more weights 139 may be secured. The weight retainer attachment 52 may be removably attached to the first side support member 50 by using a fastener 12 in combination with one or more of the openings 51 of the first side support member 50. Thus, the positioning of the weight retainer attachment 52 may vary in different embodiments, with the weight retainer attachment 52 being attached at various locations along the height of the first side support member 50 as desired by the user. It should also be appreciated that the number of elongated members of the weight retainer attachment 52 may vary in different embodiments (i.e., more or less than three may be utilized). In some embodiments, the weight retainer attachment 52 may instead be attached to the second side support member 54.

As best shown in FIG. 2, a first weight bracket 53 may be attached to the first side support member 50. The first weight bracket 53 may comprise a structure on which one or more weights 139 may be retained in an upright orientation. The positioning of the first weight bracket 53 may vary in different embodiments, and should not be construed as limited by the exemplary figures. The first weight bracket 53 may be fixedly or removably attached to the first side support member 50, such as by use of fasteners 12 removably secured within one or more of the openings 51 of the first side support member 50.

As best shown in FIG. 2, a second weight bracket 57 may be attached to the second side support member 54. The second weight bracket 57 may comprise a structure on which one or more weights 139 may be retained in an upright orientation. The positioning of the second weight bracket 57 may vary in different embodiments, and should not be construed as limited by the exemplary figures. The second weight bracket 57 may be fixedly or removably attached to the second side support member 54, such as by use of fasteners 12 removably secured within one or more of the openings 55 of the second side support member 54. It should be appreciated that embodiments with a narrower enclosure 20, such as shown in FIGS. 6-9, may omit the weight retainer brackets 53, 57.

As best shown in FIG. 2, a hook bracket 56 may be removably or fixedly attached to the second side support member 54. The hook bracket 56 may comprise a hook to which various exercise devices or the like may be removably secured. For example, a strap, mobility band, or jump rope may be retained on the hook bracket 56. The hook bracket 56 may be attached to the second side support member 54 by use of one or more fasteners 12 engaging with one or more of the openings 55 of the second side support member 54. It should be appreciated that, in some embodiments, the hook bracket 56 may instead be attached to the first side support member 50. In other embodiments, both of the first and second side support members 50, 54 may each include its own hook bracket 56.

Figure 4:
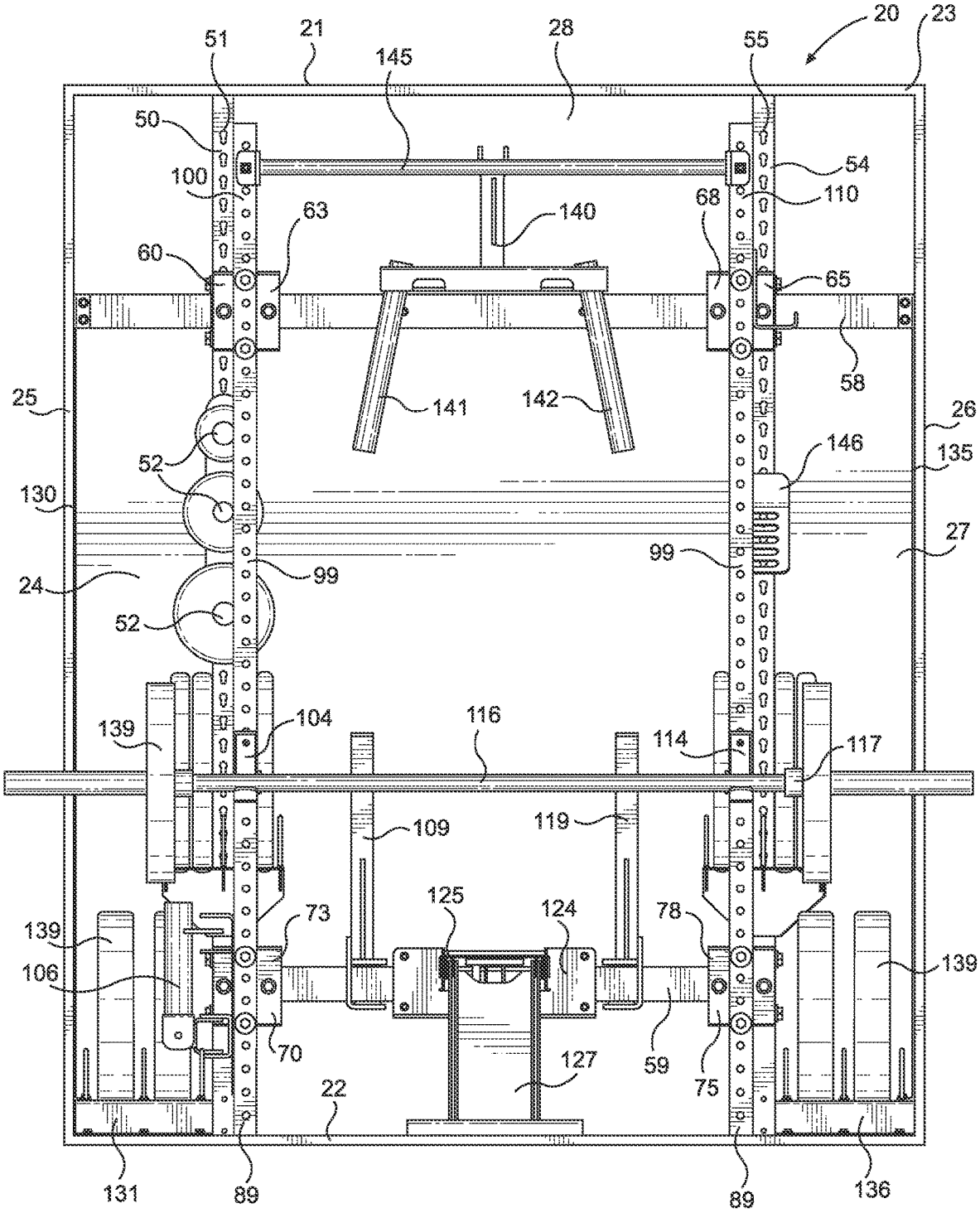
FIG. 4 is a front view of an exercise rack enclosure system with the exercise rack in an extended position in accordance with an example embodiment.
Figure 9:
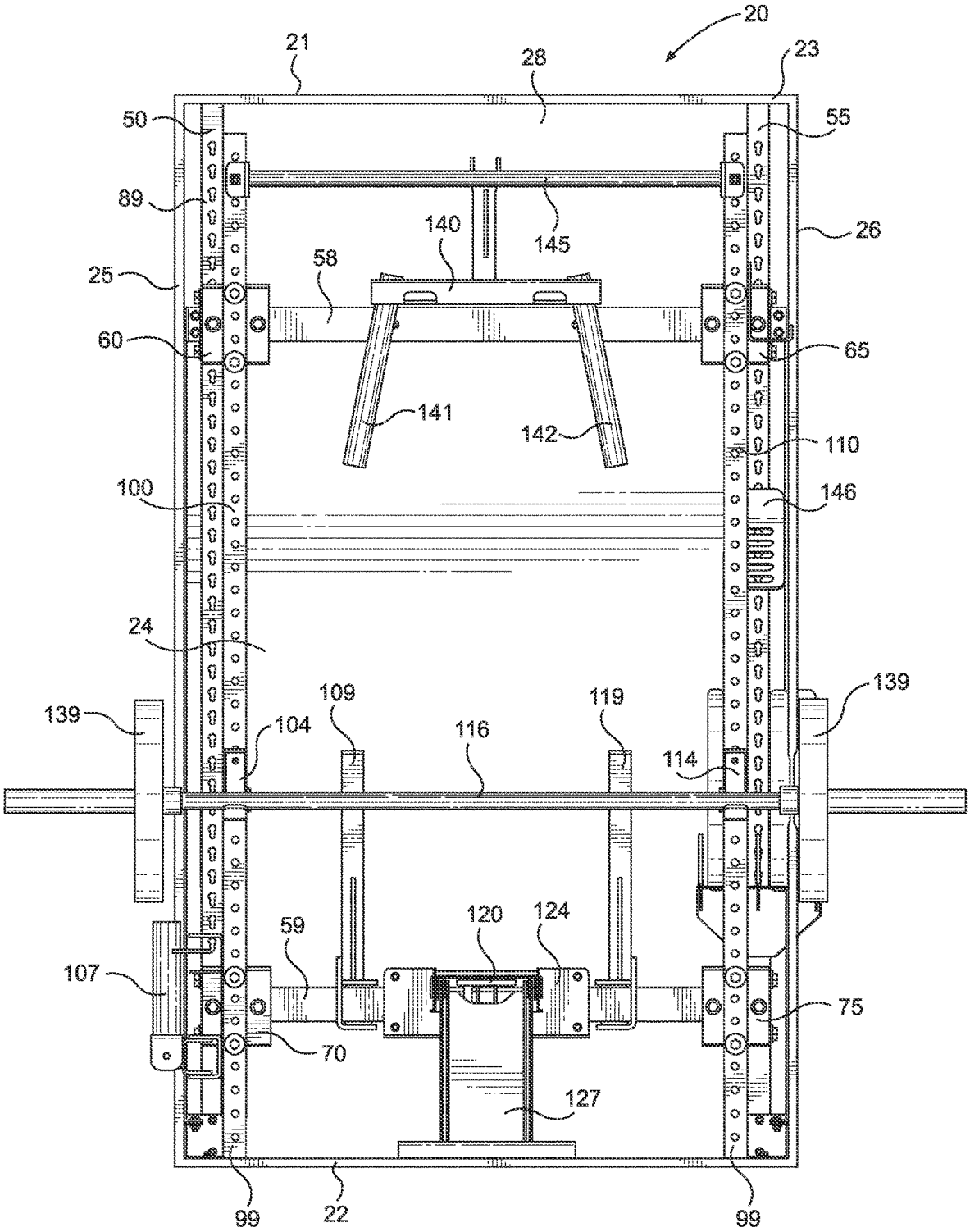
FIG. 9 is a front view of an exercise rack enclosure system with the exercise rack in an extended position in accordance with an example embodiment.

As best shown in FIGS. 4 and 9, the support frame 89 may include a pair of cross support members 58, 59 which are attached to the rear wall 24 of the enclosure 20. In the exemplary embodiment shown in the figures, a first cross support member 58 is shown being attached to the rear wall 24 of the enclosure 20 between the first and second side support members 50, 54 near the ceiling 21 of the enclosure 20. A second cross support member 59 is shown being attached to the rear wall 24 of the enclosure 20 between the first and second side support members 50, 54 near the floor 22. The first and second cross support members 58, 59 are each oriented horizontally and extend parallel to each other.

The respective ends of the first and second cross support members 58, 59 may be attached to the respective first and second side support members 50, 54. In some embodiments, however, the first and second cross support members 58, 59 may not be directly in contact with or connected to the first and second side support members 50, 54. As discussed herein, the upper connectors 60, 65 may be attached to the first cross support member 58 and the lower connectors 70, 75 may be attached to the second cross support member 59.

As best shown in FIGS. 2 and 4, the support frame 89 may include a pair of anchor members 130, 135 which are attached to the respective first and second sidewalls 25, 26 of the enclosure 20. The first anchor member 130 and the second anchor member 135 may each comprise a structural support member such as a bar, elongated plate, rod, or the like. In the exemplary embodiment shown in the figures, the first anchor member 130 is attached to the first sidewall 25 within the enclosure 20 and the second anchor member 135 is attached to the second sidewall 26 in the enclosure 20.

Each of the anchor members 130, 135 may be attached at their respective upper ends to the first cross support member 58 and at their respective lower ends to the second cross support member 59. The first anchor member 130 extends along the first sidewall 25 and the second anchor member 135 extends along the second sidewall 26. The first and second anchor members 130, 135 may be vertically-oriented, or may be diagonally-oriented. In the exemplary embodiment shown in the figures, each of the first and second anchor members 130, 135 are diagonally-oriented, with the upper ends of each of the first and second anchor members 130, 135 being closer to the rear wall 24 of the enclosure 20 and the lower ends of each of the first and second anchor members 130, 135 being closer to the front end 23 of the enclosure 20.

D. Hinge Connectors

As shown throughout the figures, the exercise rack enclosure system may include one or more connectors 60, 65, 70, 75 which are utilized to pivotably connect the exercise rack 99 to the frame 89. Each of the connectors 60, 65, 70, 75 may comprise a hinge 61, 66, 71, 76 which is attached to the frame 89, with the exercise rack 99 being pivotably attached to each hinge 61, 66, 71, 76. As discussed herein, each of the connectors 60, 65, 70, 75 may be vertically-adjustable such that the exercise rack 99 may both pivot about a vertical axis and slide up/down along the vertical axis.

In the exemplary embodiment best shown in FIGS. 2, 4, 7, 9, 14, 16, 19, and 21, it can be seen that a first upper connector 60 is attached to the first side support member 50, a second upper connector 65 is attached to the second side support member 54, a first lower connector 70 is attached to the first side support member 50, and a second lower connector 75 is attached to the second side support member 50. As shown in the figures, the first and second upper connectors 60, 65 may additionally be connected to the first cross support member 58 and the first and second lower connectors 70, 75 may additionally be connected to the second cross support member 59.

The first and second upper connectors 60, 65 may be attached near the ceiling 21 of the enclosure 20 and the first and second lower connectors 70, 75 may be attached near the floor 22 of the enclosure 20. However, the number and positioning of the connectors 60, 65, 70, 75 may vary in different embodiments. For example, in some embodiments, only a pair of connectors 60, 65, 70, 75 may be utilized (e.g., only a pair of upper connectors 60, 65, only a pair of lower connectors 70, 75, only a first upper connector 60 and a second lower connector 75, or only a second upper connector 65 and a first lower connector 70).

As best shown in FIG. 2, the first upper connector 60 may comprise a first upper bracket 63 which is attached to the first side support member 50 and/or first cross support member 58, such as by use of fasteners 12. The first upper bracket 63 may include first upper and lower members 64*a*, 64*b* which comprise plates or the like which extend perpendicular to the first side support member 50. Thus, a first upper member 64*a* and a first lower member 64*b* may extend parallel to each other. The first upper and lower members 64*a*, 64*b* may each include openings which may act as temporary locks in which the first upper rod 62 may engage to lock the exercise rack 99 in various positions with respect to the first upper connector 60.

The first upper connector 60 may comprise a first upper hinge 61 to which the first rack member 100 of the exercise rack 99 may be pivotably connected. The first upper hinge 61 may comprise a pivoting member such as a rod or the like which allows the first rack member 100 to be pivoted about a vertical axis extending through the first upper hinge 61. The first upper connector 60 may include a first upper rod 62 which is connected to the first upper connector 60. The first upper rod 62 may be adapted to selectively and removably engage with one or more of the openings in the upper and lower members 64*a*, 64*b* of the first upper bracket 63 to temporarily lock the exercise rack 99 in a certain position with respect to the first upper connector 60.

As discussed herein, the first rack member 100, and more specifically the first upper linkage 80 of the first rack member 100, may be movably connected to the first upper hinge 61. More specifically, as shown in the figures, the first upper linkage 80 may be pivotably connected to the first upper hinge 61 of the first upper connector 60. It should be appreciated that, in some embodiments, the first upper linkage 80 may be adapted to pivot about the first upper hinge 61. In other embodiments, the first upper linkage 80 may be secured to the first upper hinge 61, with the first upper hinge 61 being rotatably connected to the upper and/or lower members 64*a*, 64*b*.

A first upper rod 62 may extend through the first upper linkage 80. The first upper rod 62 will generally pivot with the first upper linkage 80. The first upper rod 62 may be adapted to selectively engage within one of the openings of the upper or lower members 64*a*, 64*b* of the first upper bracket 63 so as to selectively lock the first upper linkage 80 in a certain position with respect to the first upper connector 60.

Figure 5A:
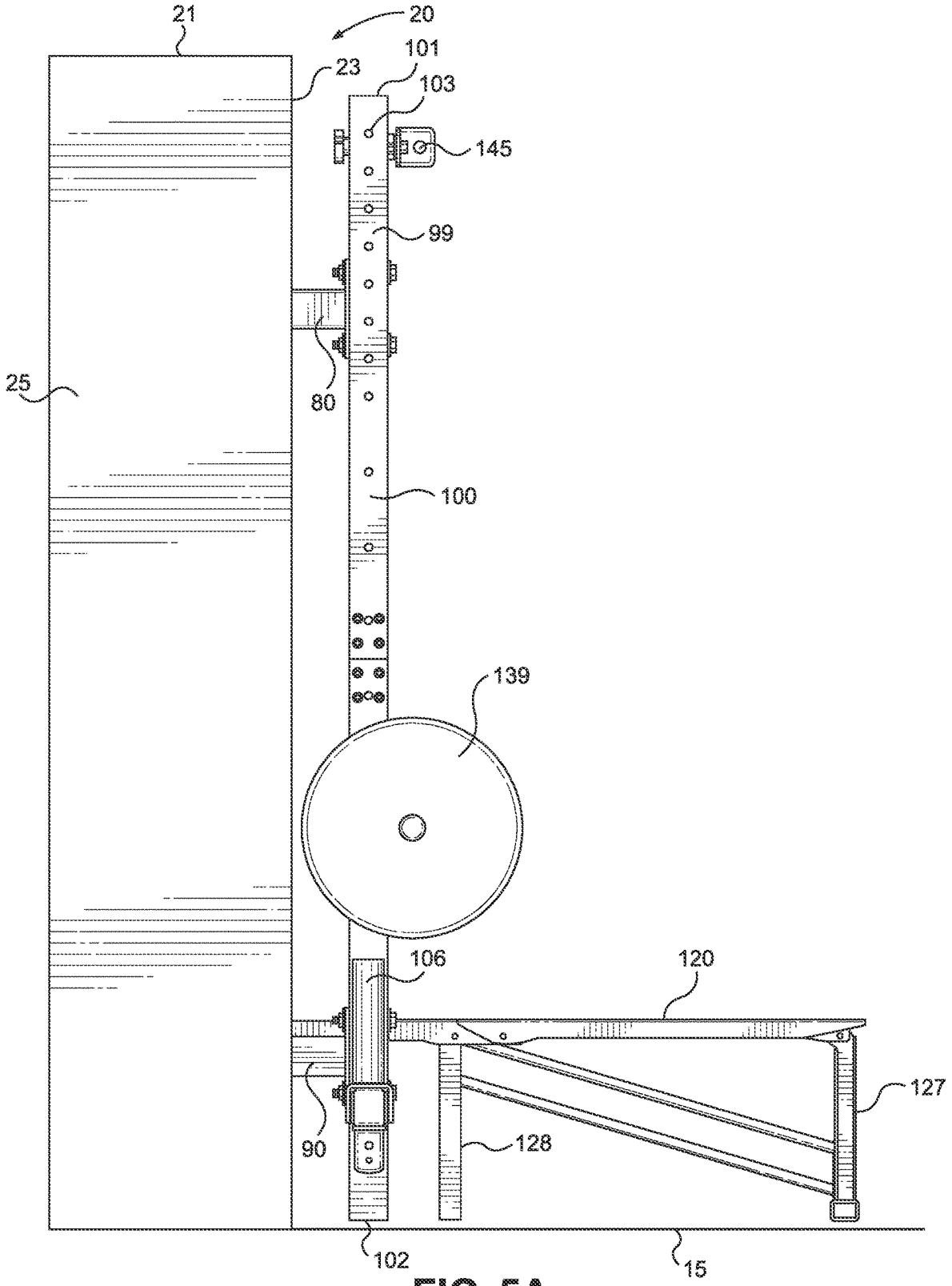
FIG. 5A is a first side view of an exercise rack enclosure system with the exercise rack in a raised position in accordance with an example embodiment.
Figure 10A:
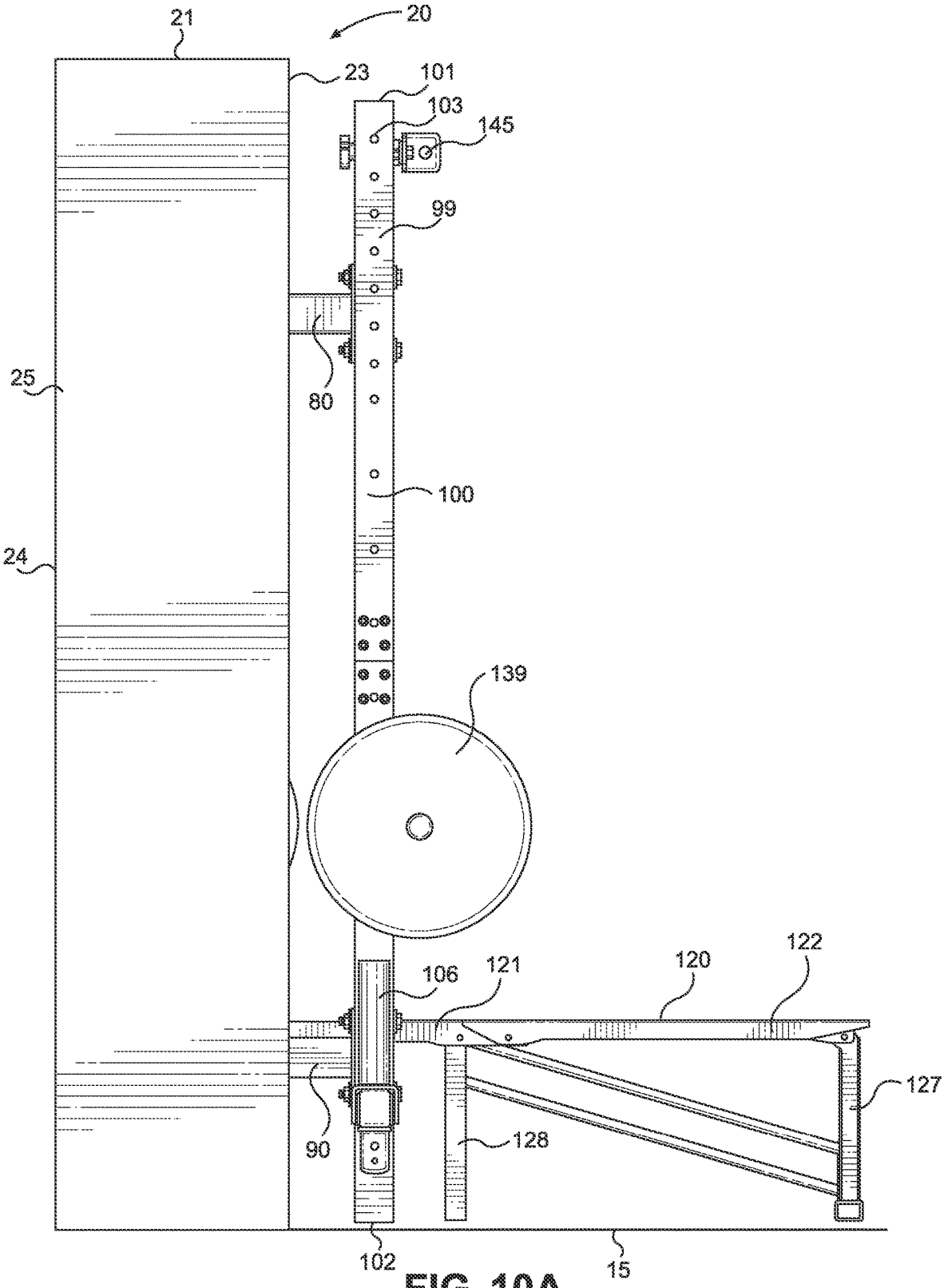
FIG. 10A is a first side view of an exercise rack enclosure system with the exercise rack in a raised position in accordance with an example embodiment.
Figure 10B:
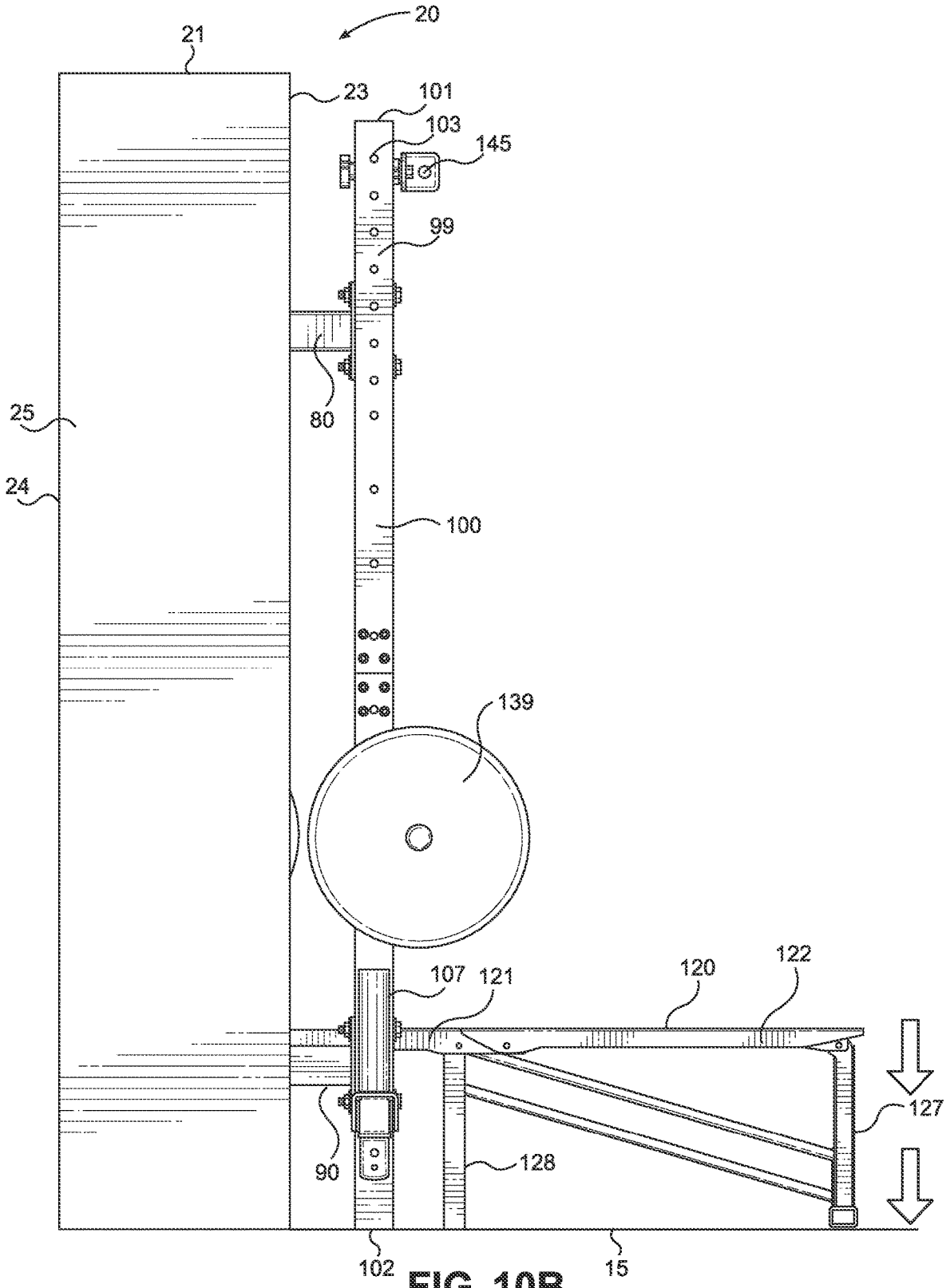
FIG. 10B is a first side view of an exercise rack enclosure system with the exercise rack in a lowered position in accordance with an example embodiment.

As best shown in FIGS. 5A, 5B, 10A, and 10B, it can also be seen that the first upper linkage 80 may be slidably or otherwise movably connected to the first upper hinge 61 such that the first upper linkage 80 is vertically-adjustable with respect to the first upper hinge 61. The first upper rod 62 is fixed to the first upper linkage 80 such that the first upper rod 62 vertically adjusts with the first upper linkage 80. When the first upper linkage 80 is in a raised position, the first upper rod 62 may engage within one of the openings of the first upper member 64*a* of the first upper bracket 63. When the first upper linkage 80 is in the lowered position, the first upper rod 62 may engage within one of the openings of the first lower member 64*b*. In this manner, the exercise rack 99 may be vertically-adjusted between a raised position, such as shown in FIGS. 5A and 10A, and a lowered position, such as shown in FIGS. 10A and 10B. The first upper hinge 61 may include a first flange 155 positioned at the lower distal end of the first upper hinge 61 on which the first upper linkage 80 rests when in the lowered position.

As best shown in FIG. 2, the second upper connector 65 may comprise a second upper bracket 68 which is attached to the second side support member 54, and/or first cross support member 58 such as by use of fasteners 12. The second upper bracket 68 may include second upper and lower members 69*a*, 69*b* which comprise plates or the like which extend perpendicular to the second side support member 54. Thus, a second upper member 69*a* and a second lower member 69*b* may extend parallel to each other. The second upper and lower members 69*a*, 69*b* may each include openings which may act as temporary locks in which the second upper rod 67 may engage to lock the exercise rack 99 in various positions with respect to the second upper connector 65.

Figure 11A:
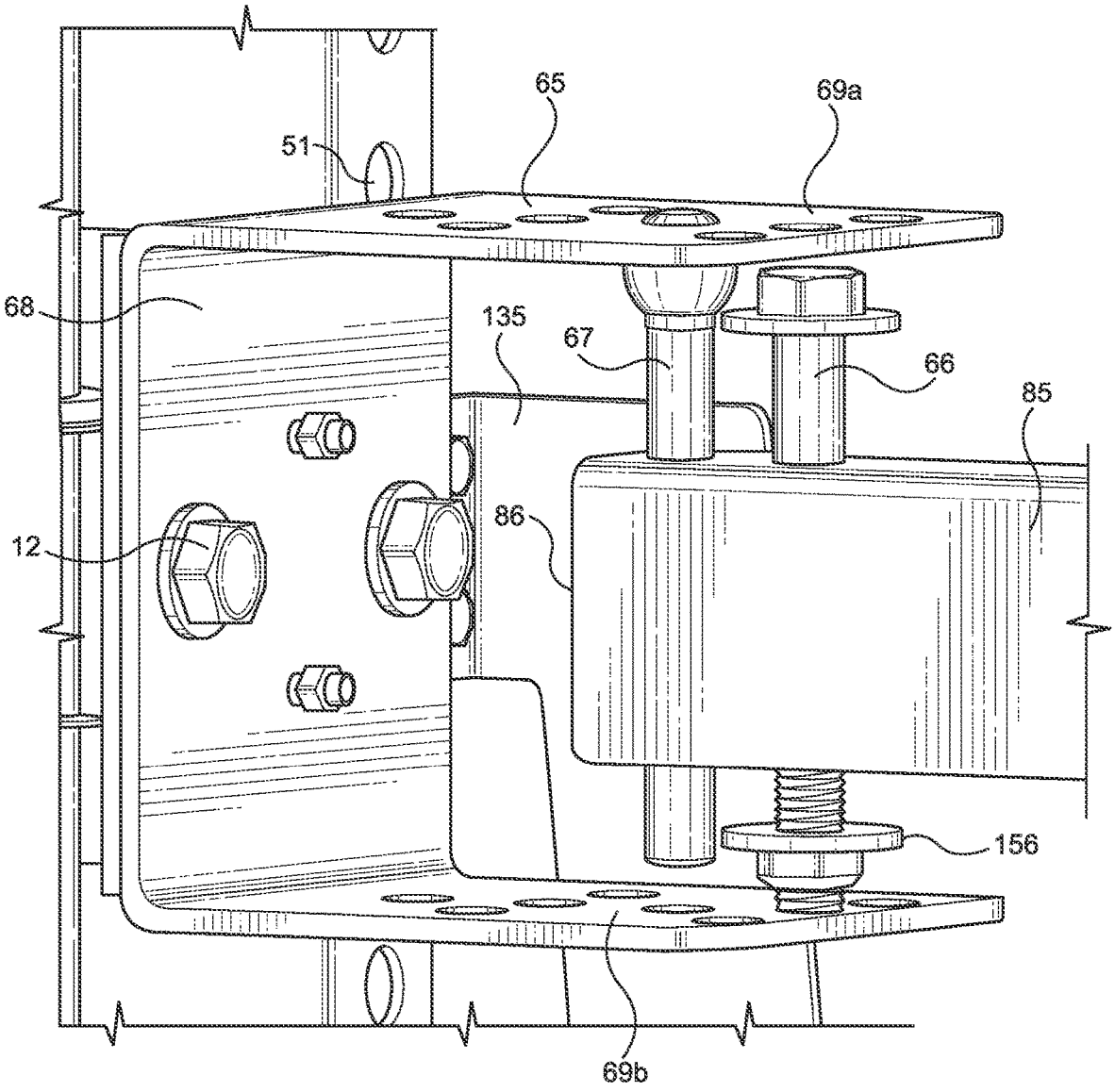
FIG. 11A is a perspective view of an exemplary connector of an exercise rack enclosure system in accordance with an example embodiment.
Figure 11B:
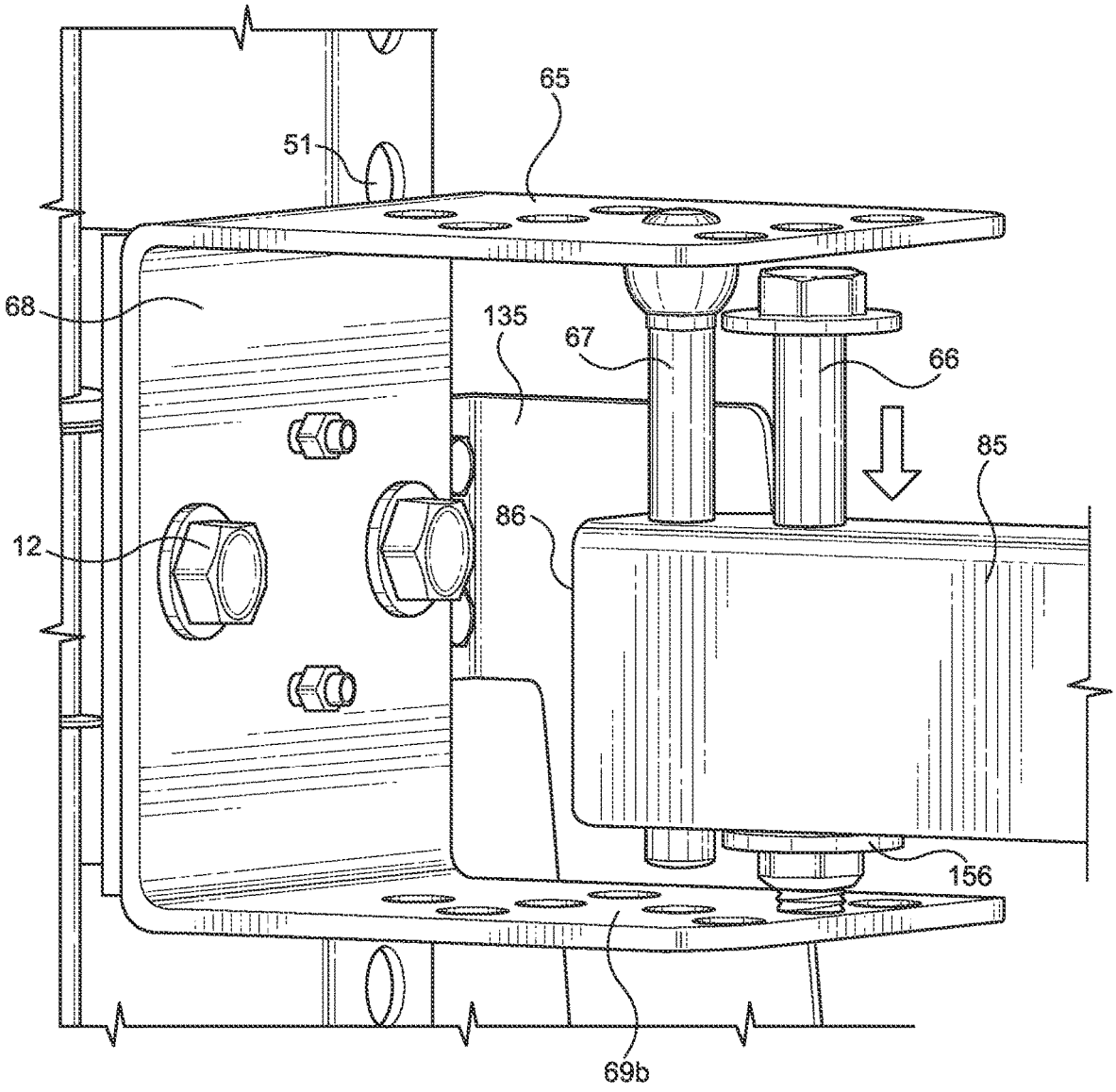
FIG. 11B is a perspective view of an exemplary connector with the exercise rack in a lowered position in accordance with an example embodiment.
Figure 12:
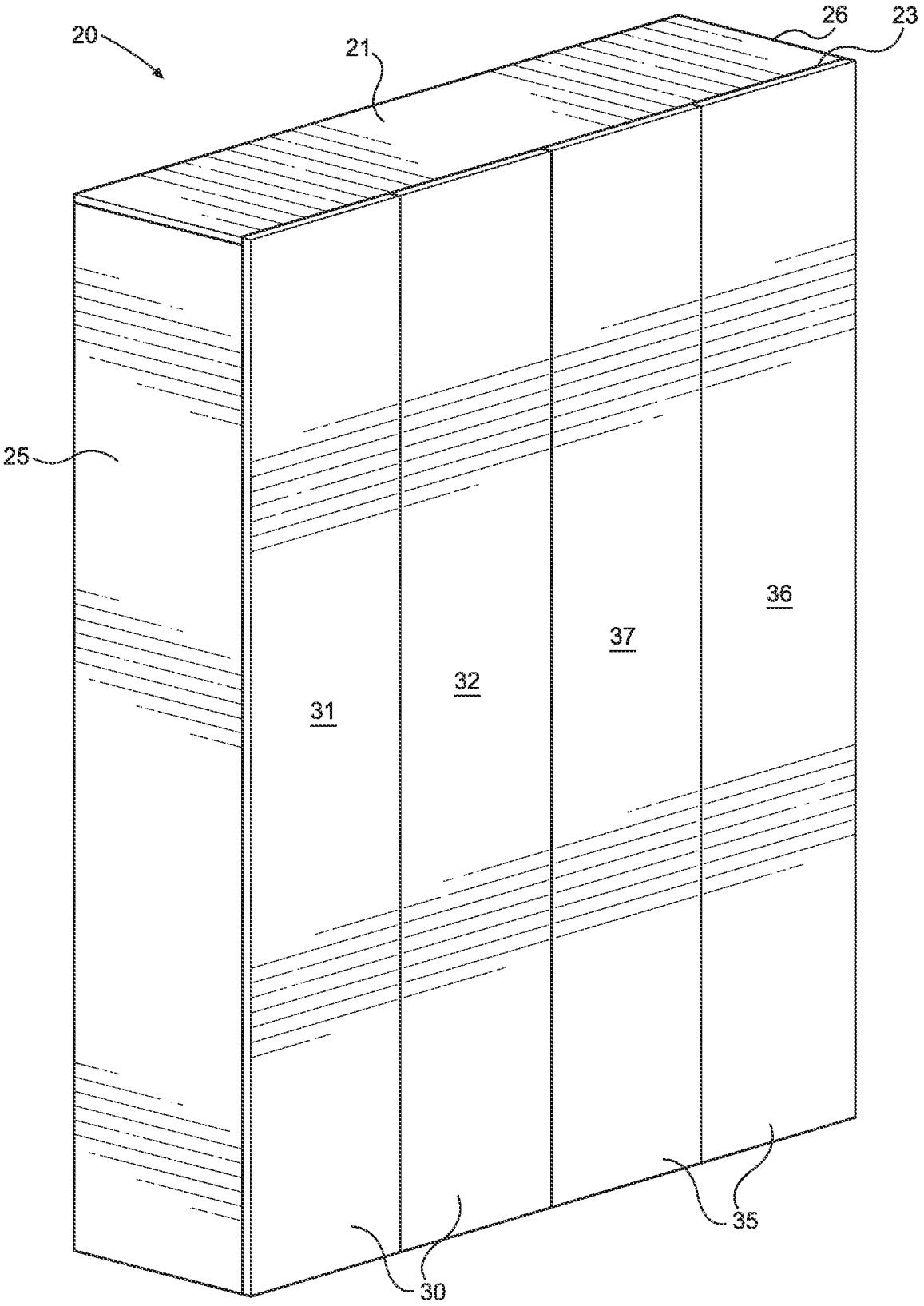
FIG. 12 is a perspective view of an exercise rack enclosure system with the doors closed in accordance with an example embodiment.

The second upper connector 65 may comprise a second upper hinge 66 to which the second rack member 110 of the exercise rack 99 may be pivotably connected. The second upper hinge 66 may comprise a pivoting member such as a rod or the like which allows the second rack member 110 to be pivoted about a vertical axis extending through the second upper hinge 66. The second upper connector 65 may include a second upper rod 67 which is connected to the second upper connector 65 as shown in FIGS. 11A and 11B. The second upper rod 67 may be adapted to selectively and removably engage with one or more of the openings in the upper and lower members 69*a*, 69*b* of the second upper bracket 68 to temporarily lock the exercise rack 99 in a certain position with respect to the second upper connector 65.

As discussed herein, the second rack member 110, and more specifically the second upper linkage 85 of the second rack member 110, may be movably connected to the second upper hinge 66. More specifically, as shown in the figures, the second upper linkage 85 may be pivotably connected to the second upper hinge 66 of the second upper connector 65. It should be appreciated that, in some embodiments, the second upper linkage 85 may be adapted to pivot about the second upper hinge 66. In other embodiments, the second upper linkage 85 may be secured to the second upper hinge 66, with the second upper hinge 66 being rotatably connected to the upper and/or lower members 69*a*, 69*b*.

A second upper rod 67 may extend through the second upper linkage 85. The second upper rod 67 will generally pivot with the second upper linkage 85. The second upper rod 67 may be adapted to selectively engage within one of the openings of the upper or lower members 69*a*, 69*b* of the second upper bracket 68 so as to selectively lock the second upper linkage 85 in a certain position with respect to the second upper connector 65.

Figure 5B:
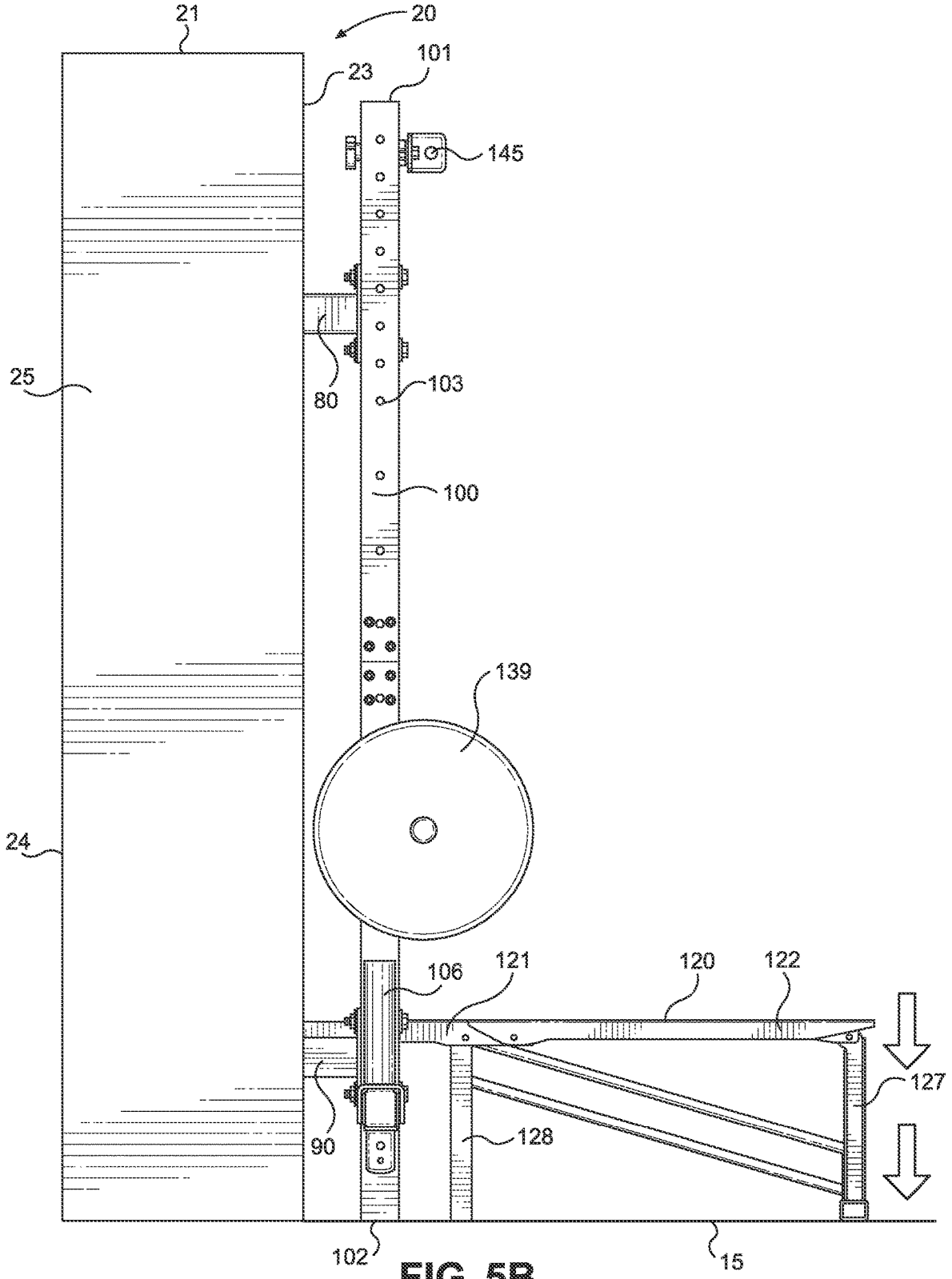
FIG. 5B is a first side view of an exercise rack enclosure system with the exercise rack in a lowered position in accordance with an example embodiment.

As best shown in FIGS. 5A, 5B, 10A, and 10B, it can also be seen that the second upper linkage 85 may be slidably or otherwise movably connected to the second upper hinge 66 such that the second upper linkage 85 is vertically-adjustable with respect to the second upper hinge 66. The second upper rod 67 is fixed to the second upper linkage 85 such that the second upper rod 67 vertically adjusts with the second upper linkage 85. When the second upper linkage 85 is in a raised position, the second upper rod 67 may engage within one of the openings of the second upper member 69*a* of the second upper bracket 68. When the second upper linkage 85 is in the lowered position, the second upper rod 67 may engage within one of the openings of the second lower member 69*b*. In this manner, the exercise rack 99 may be vertically-adjusted between a raised position, such as shown in FIGS. 5A and 10A, and a lowered position, such as shown in FIGS. 5B and 10B. The second upper hinge 66 may include a second flange 156 positioned at the lower distal end of the second upper hinge 66 on which the second upper linkage 85 rests when in the lowered position.

As best shown in FIG. 2, the first lower connector 70 may comprise a first lower bracket 73 which is attached to the second side support member 54 and/or second cross support member 59, such as by use of fasteners 12. The first lower bracket 73 may include first upper and lower members 74*a*, 74*b* which comprise plates or the like which extend perpendicular to the first side support member 50. Thus, a first upper member 74*a* and a first lower member 74*b* may extend parallel to each other. The first upper and lower members 74*a*, 74*b* may each include openings which may act as temporary locks in which the first lower rod 72 may engage to lock the exercise rack 99 in various positions with respect to the first lower connector 70.

The first lower connector 70 may comprise a first lower hinge 71 to which the second rack member 110 of the exercise rack 99 may be pivotably connected. The first lower hinge 71 may comprise a pivoting member such as a rod or the like which allows the first rack member 100 to be pivoted about a vertical axis extending through the first lower hinge 71. The first lower connector 70 may include a first lower rod 72 which is connected to the first lower connector 70. The first lower rod 72 may be adapted to selectively and removably engage with one or more of the openings in the upper and lower members 69*a*, 69*b* of the first lower bracket 73 to temporarily lock the exercise rack 99 in a certain position with respect to the first lower connector 70.

As discussed herein, the first rack member 100, and more specifically the first lower linkage 90 of the first rack member 100, may be movably connected to the first lower hinge 71. More specifically, as shown in the figures, the first lower linkage 90 may be pivotably connected to the first lower hinge 71 of the first lower connector 70. It should be appreciated that, in some embodiments, the first lower linkage 90 may be adapted to pivot about the first lower hinge 71. In other embodiments, the first lower linkage 90 may be secured to the first lower hinge 71, with the first lower hinge 71 being rotatably connected to the upper and/or lower members 74*a*, 74*b*.

A first lower rod 72 may extend through the first lower linkage 90. The first lower rod 72 will generally pivot with the first lower linkage 90. The first lower rod 72 may be adapted to selectively engage within one of the openings of the upper or lower members 74*a*, 74*b* of the first lower bracket 73 so as to selectively lock the first lower linkage 90 in a certain position with respect to the first lower connector 70.

As best shown in FIGS. 5A, 5B, 10A, and 10B, it can also be seen that the first lower linkage 90 may be slidably or otherwise movably connected to the first lower hinge 71 such that the first lower linkage 90 is vertically-adjustable with respect to the first lower hinge 71. The first lower rod 72 is fixed to the first lower linkage 90 such that the first lower rod 72 vertically adjusts with the first lower linkage 90. When the lower upper linkage 90 is in a raised position, the first lower rod 72 may engage within one of the openings of the first upper member 74*a* of the first lower bracket 73. When the first lower linkage 90 is in the lowered position, the first lower rod 72 may engage within one of the openings of the first lower member 74*b*. In this manner, the exercise rack 99 may be vertically-adjusted between a raised position, such as shown in FIGS. 5A and 10A, and a lowered position, such as shown in FIGS. 5B and 10B. The first lower hinge 71 may include a third flange 157 positioned at the lower distal end of the first lower hinge 71 on which the first lower linkage 90 rests when in the lowered position.

As best shown in FIG. 2, the second lower connector 75 may comprise a second lower bracket 78 which is attached to the second side support member 54 and/or second cross support member 59, such as by use of fasteners 12. The second lower bracket 78 may include second upper and lower members 79*a*, 79*b* which comprise plates or the like which extend perpendicular to the second side support member 54. Thus, a second upper member 79*a* and a second lower member 79*b* may extend parallel to each other. The second upper and lower members 79*a*, 79*b* may each include openings which may act as temporary locks in which the second lower rod 77 may engage to lock the exercise rack 99 in various positions with respect to the second lower connector 75.

The second lower connector 75 may comprise a second lower hinge 76 to which the second rack member 110 of the exercise rack 99 may be pivotably connected. The second lower hinge 76 may comprise a pivoting member such as a rod or the like which allows the second rack member 110 to be pivoted about a vertical axis extending through the second lower hinge 76. The second lower connector 75 may include a second lower rod 77 which is connected to the second lower connector 75. The second lower rod 77 may be adapted to selectively and removably engage with one or more of the openings in the upper and lower members 79*a*, 79*b* of the second lower bracket 78 to temporarily lock the exercise rack 99 in a certain position with respect to the second lower connector 75.

As discussed herein, the second rack member 110, and more specifically the second lower linkage 95 of the second rack member 110, may be movably connected to the second lower hinge 76. More specifically, as shown in the figures, the second upper linkage 85 may be pivotably connected to the second lower hinge 76 of the second lower connector 75. It should be appreciated that, in some embodiments, the second lower linkage 95 may be adapted to pivot about the second lower hinge 76. In other embodiments, the second lower linkage 95 may be secured to the second lower hinge 76, with the second lower hinge 76 being rotatably connected to the upper and/or lower members 79*a*, 79*b*.

A second lower rod 77 may extend through the second lower linkage 95. The second lower rod 77 will generally pivot with the second lower linkage 95. The second lower rod 77 may be adapted to selectively engage within one of the openings of the upper or lower members 79*a*, 79*b* of the second lower bracket 78 so as to selectively lock the second lower linkage 95 in a certain position with respect to the second lower connector 75.

As best shown in FIGS. 5A, 5B, 10A, and 10B, it can also be seen that the second lower linkage 95 may be slidably or otherwise movably connected to the second lower hinge 76 such that the second lower linkage 95 is vertically-adjustable with respect to the second lower hinge 76. The second lower rod 77 is fixed to the second lower linkage 95 such that the second lower rod 77 vertically adjusts with the second lower linkage 95. When the second lower linkage 95 is in a raised position, the second lower rod 77 may engage within one of the openings of the second upper member 79*a* of the second lower bracket 78. When the second lower linkage 95 is in the lowered position, the second lower rod 77 may engage within one of the openings of the second lower member 79*b*. In this manner, the exercise rack 99 may be vertically-adjusted between a raised position, such as shown in FIGS. 5A and 10A, and a lowered position, such as shown in FIGS. 5B and 10B. The second lower hinge 76 may include a fourth flange 158 positioned at the lower distal end of the second lower hinge 76 on which the second lower linkage 95 rests when in the lowered position.

E. Exercise Rack

As shown throughout the figures, the exercise rack enclosure system will generally include an exercise rack 99 which is adjustably connected within the enclosure 20 and adjustable between a collapsed position in which the exercise rack 99 is completely within the interior space 28 of the enclosure 20 and an extended position in which at least a portion of the exercise rack 99 extends outwardly from the enclosure 20 through the front opening 27.

Various types of exercise racks 99 may be utilized in different embodiments, and the exemplary exercise rack 99 shown in the figures should thus not be construed as limiting in scope. By way of example and without limitation, the exemplary exercise racks 99 shown and described in U.S. Pat. Nos. 9,333,387, 10,195,479, and 10,953,301 may be utilized in connection with the exercise rack enclosure system, the entire disclosures of which, except for any definitions, disclaimers, disavowals, and inconsistencies, are incorporated herein by reference.

In the exemplary embodiment shown in the figures, the exercise rack 99 is shown as being comprised of a pair of rack members 100, 110 which are each pivotably connected to the frame 89 within the enclosure 20 so as to be adjustable between the collapsed position for storage and the extended position for usage. More specifically, in the exemplary embodiment shown in the figures, the first rack member 100 may be pivotably connected to the first side support member 50 of the frame 89 and the second rack member 110 may be pivotably connected to the second side support member 54 of the frame 89.

Figure 6:
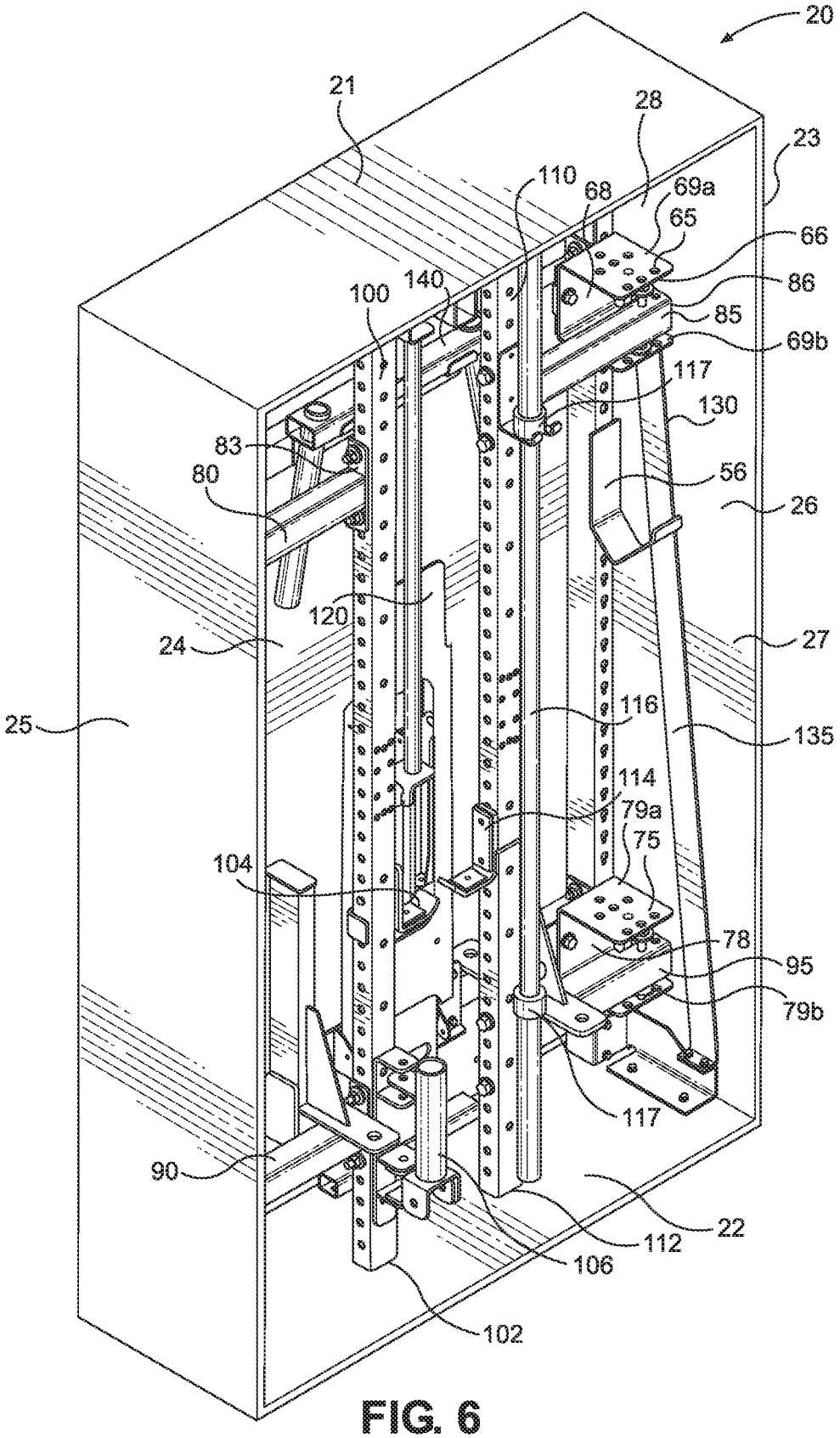
FIG. 6 is a perspective view of an exercise rack enclosure system with the exercise rack in a collapsed position in accordance with an example embodiment.

As shown in FIGS. 1-4 and 6-9, each of the rack members 100, 110 may include one or more linkages 80, 85, 90, 95 which are pivotably connected to the frame 89, such as by the use of hinge connectors 60, 65, 70, 75. As shown in FIG. 6, it can be seen that the first rack member 100 may include a first upper linkage 80 and a first lower linkage 90 and that the second rack member 110 may include a second upper linkage 85 and a second lower linkage 95. The linkages 80, 85, 90, 95 may each be comprised of an elongated member such as a bar, post, or the like which is connected between the respective rack members 100, 110 and the frame 89.

As best shown in FIG. 5A, the exercise rack 99 generally includes a first rack member 100 having an upper end 101 and a lower end 102. The first rack member 100 may comprise an elongated member having a plurality of openings 103 to which various accessories, attachments, or other exercise equipment may be removably attached for performing various exercise moves. The shape, size, and orientation of the first rack member 100 may vary in different embodiments, and should not be construed as limited by the exemplary figures.

Continuing to reference FIG. 5A, it can be seen that the first rack member 100 is pivotably connected to the first side support member 50 of the frame 89 by a first upper linkage 80 and a first lower linkage 90. The first upper linkage 80 is comprised of a first end 81 which is pivotably connected to the first side support member 50 and a second end 82 which is connected to the first rack member 100 near an upper end 101 thereof. More specifically, it can be seen that the first end 81 of the first upper linkage 80 is pivotably connected to the first upper connector 60. The first upper linkage 80 may be pivotably connected to pivot around the first upper hinge 61 of the first upper connector 60 or may be fixedly connected to the upper hinge 61 of the first upper connector 60, with the upper hinge 61 being rotatable.

The second end 82 of the first upper linkage 80 may be connected to the first rack member 100 by a first upper bracket 83 such as shown in FIG. 1. The first upper bracket 83 may be integral with the second end 82 of the first upper linkage 80 or may be connected thereto. The first upper bracket 83 may include one or more openings that align with one or more openings 103 of the first rack member 100 to be secured thereto by one or more fasteners 12. In this manner, the positioning of the first upper linkage 80 with respect to the first rack member 100 may be adjusted as-needed.

The first lower linkage 90 is comprised of a first end 91 which is pivotably connected to the first side support member 50 and a second end 92 which is connected to the first rack member 100 near a lower end 102 thereof. More specifically, it can be seen that the first end 91 of the first lower linkage 90 is pivotably connected to the first lower connector 70. The first lower linkage 90 may be pivotably connected to pivot around the first lower hinge 71 of the first lower connector 70 or may be fixedly connected to the first lower hinge 71 of the first lower connector 70, with the first lower hinge 71 being rotatable.

The second end 92 of the first lower linkage 90 may be connected to the first rack member 100 by a first lower bracket 93 such as shown in FIG. 2. The first lower bracket 93 may be integral with the second end 92 of the first lower linkage or may be connected thereto. The first lower bracket 93 may include one or more openings that align with one or more openings 103 of the first rack member 100 to be secured thereto by one or more fasteners 12. In this manner, the positioning of the first lower linkage 90 with respect to the first rack member 100 may be adjusted as-needed.

As best shown in FIG. 1, the exercise rack 99 generally includes a second rack member 110 having an upper end 111 and a lower end 112. The second rack member 110 may comprise an elongated member having a plurality of openings 113 to which various accessories, attachments, or other exercise equipment may be removably attached for performing various exercise moves. The shape, size, and orientation of the second rack member 110 may vary in different embodiments, and should not be construed as limited by the exemplary figures.

Continuing to reference FIG. 1, it can be seen that the second rack member 110 is pivotably connected to the second side support member 54 of the frame 89 by a second upper linkage 85 and a second lower linkage 95. The second upper linkage 85 is comprised of a first end 86 which is pivotably connected to the second side support member 54 and a second end 87 which is connected to the second rack member 110 near an upper end 111 thereof. More specifically, it can be seen that the first end 86 of the second upper linkage 85 is pivotably connected to the second upper connector 65. The second upper linkage 85 may be pivotably connected to pivot around the second upper hinge 66 of the second upper connector 65 or may be fixedly connected to the second upper hinge 66 of the second upper connector 65, with the second upper hinge 66 being rotatable.

Figure 8:
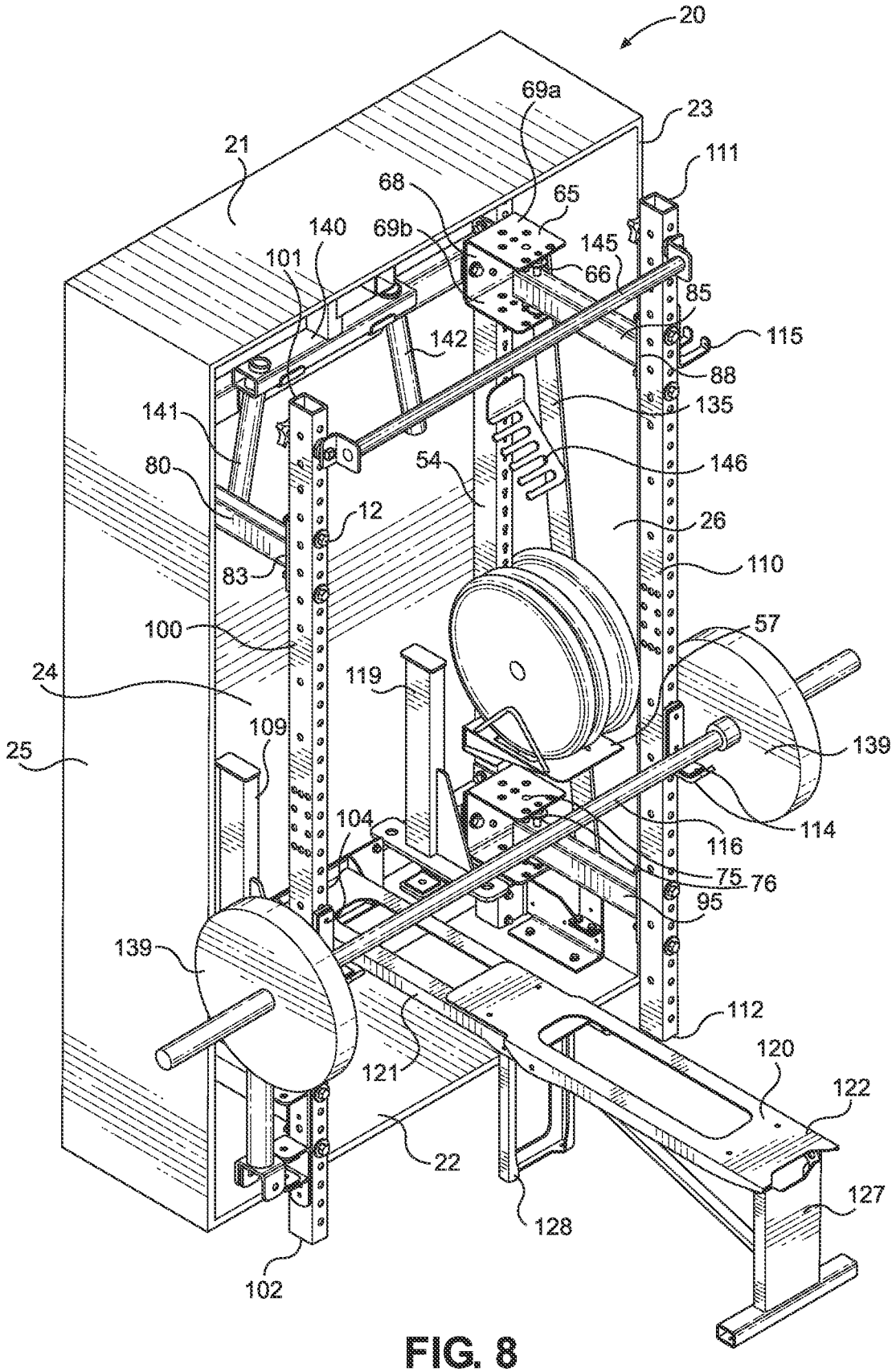
FIG. 8 is a perspective view of an exercise rack enclosure system with the exercise rack in an extended position in accordance with an example embodiment.

The second end 87 of the second upper linkage 85 may be connected to the second rack member 110 by a second upper bracket 88 such as shown in FIG. 8. The second upper bracket 88 may be integral with the second end 87 of the second upper linkage 85 or may be connected thereto. The second upper bracket 88 may include one or more openings that align with one or more openings 113 of the second rack member 110 to be secured thereto by one or more fasteners 12. In this manner, the positioning of the second upper linkage 85 with respect to the second rack member 110 may be adjusted as-needed.

The second lower linkage 95 is comprised of a first end 96 which is pivotably connected to the second side support member 54 and a second end 97 which is connected to the second rack member 110 near a lower end 112 thereof. More specifically, it can be seen that the first end 96 of the second lower linkage 95 is pivotably connected to the second lower connector 75. The second lower linkage 95 may be pivotably connected to pivot around the second lower hinge 76 of the second lower connector 75 or may be fixedly connected to the second lower hinge 76 of the second lower connector 75, with the second lower hinge 76 being rotatable.

The second end 97 of the second lower linkage 95 may be connected to the second rack member 110 by a second lower bracket 98. The second lower bracket 98 may be integral with the second end 97 of the second lower linkage 95 or may be connected thereto. The second lower bracket 98 may include one or more openings that align with one or more openings 113 of the second rack member 110 to be secured thereto by one or more fasteners 12. In this manner, the positioning of the second lower linkage 95 with respect to the second rack member 110 may be adjusted as-needed.

Generally, the first and second rack members 100, 110 will be parallel to each other and each extend vertically between their respective upper ends 101, and lower ends 102, 112. The first and second rack members 100, 110 may be independently adjustable between their respective positions, or may be interlinked together such that the first and second rack members 100, 110 are adjusted together (i.e., adjustment of the first rack member 100 also automatically adjusts the second rack member 110).

As shown in the figures, the linkages 80, 85, 90, 95 of the exercise rack 99 will generally be parallel to the rear wall 24 of the enclosure 20 when the exercise rack 99 is in the collapsed position, and perpendicular to the rear wall 24 of the enclosure 20 when the exercise rack 99 is in the extended position. Thus, the first rack member 100, first upper linkage 80, and first lower linkage 90 may be adapted to pivot ninety degrees between the collapsed position and the extended position. Similarly, the second rack member 110, second upper linkage 85, and second lower linkage 95 may be adapted to pivot ninety degrees in the opposite direction between the collapsed position and the extended position. In this manner, the first rack member 100 may be adapted to swing towards and away from the second rack member 110, and the second rack member 110 may be adapted to swing toward and away from the first rack member 100.

F. Bench

As best shown in FIGS. 3, 4, 8, 9, 10A, 10B, 13-16, and 18-21, the exercise rack enclosure system may include a bench 120 that is adjustable between a collapsed position, in which the bench 120 is secured against the rear wall 24 of the enclosure 20, and an extended position, in which the bench 120 extends at least partially out of the enclosure 20 through the front opening 27. The bench 120 may be utilized to perform a wide range of exercise moves, such as weight-lifting.

Figure 21:
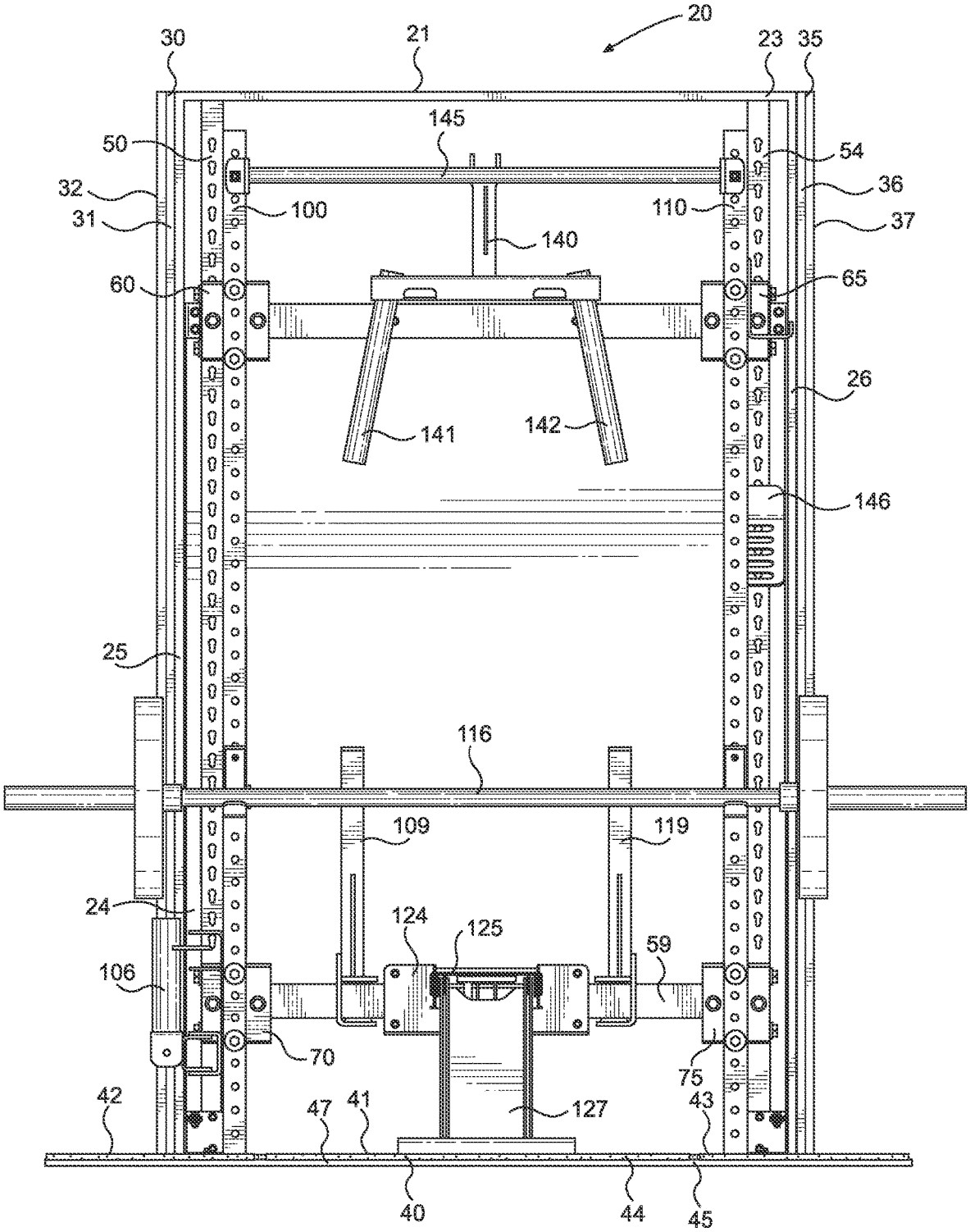
FIG. 21 is a front view of an exercise rack enclosure system with the doors opened and folded against the enclosure and the platform lowered in accordance with an example embodiment.
Figure 22:
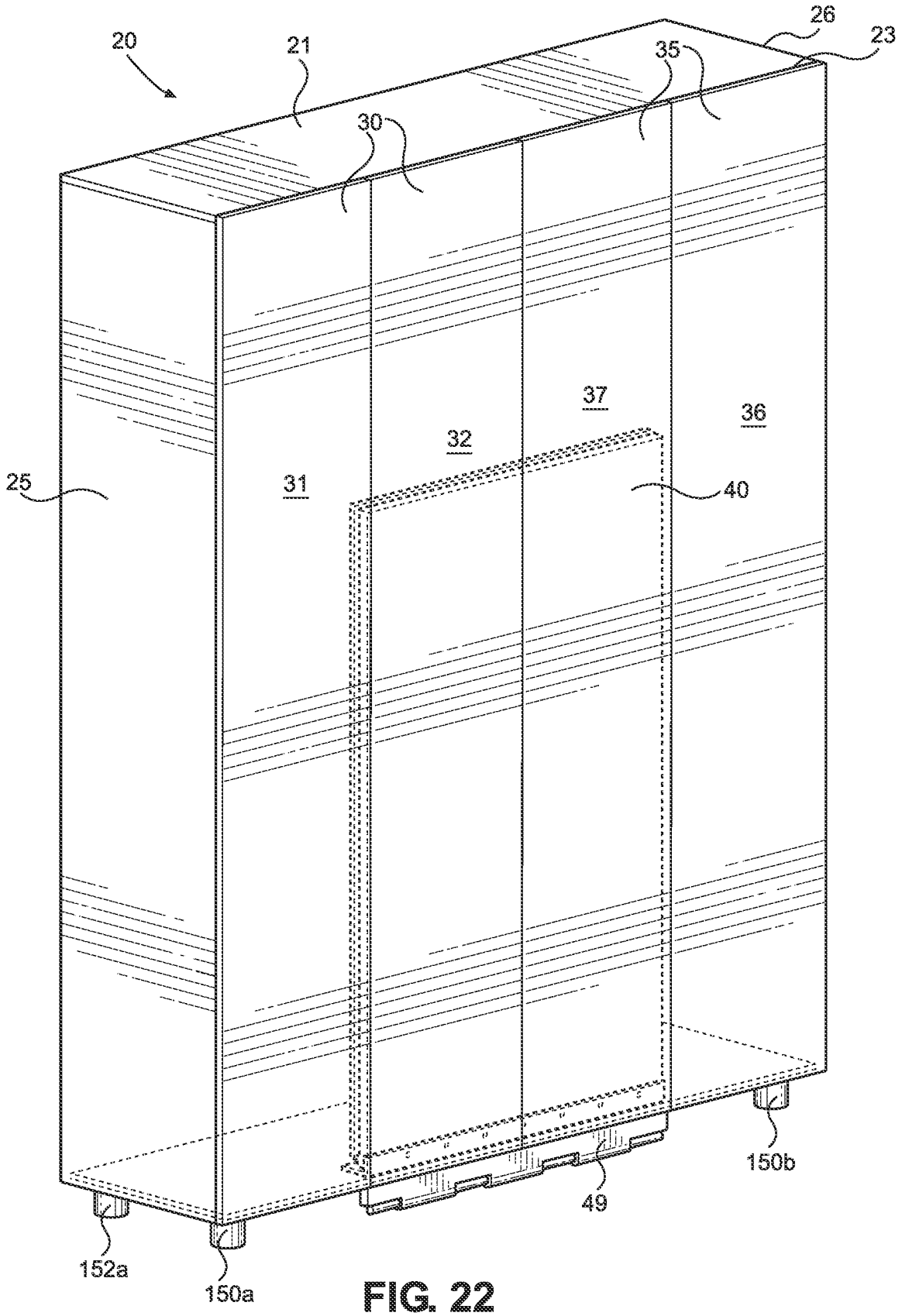
FIG. 22 is a perspective view of an exercise rack enclosure system with the doors closed and the platform raised in accordance with an example embodiment.
Figure 23:
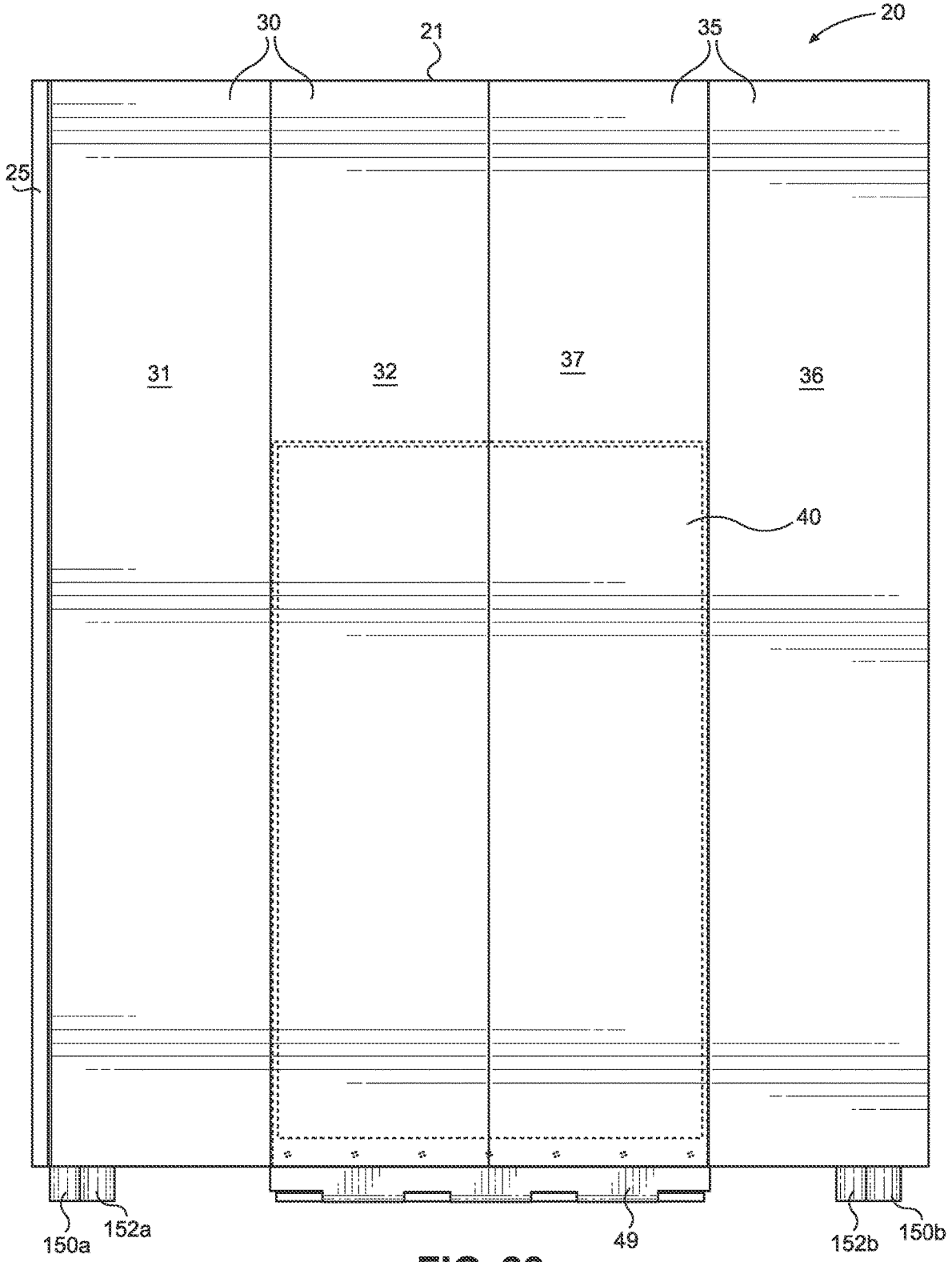
FIG. 23 is a front view of an exercise rack enclosure system with the doors closed and the platform raised in accordance with an example embodiment.

As shown in FIG. 21, the bench 120 may be connected to the enclosure 20 by a bench bracket 124. The bench bracket 124 may be connected to the second cross member 59 of the frame 89, or may be directly connected to the rear wall 24 of the enclosure 20. The bench bracket 124 may include a bench hinge 125 which allows the bench 120 to pivot about a horizontal axis upwardly into the collapsed position against the enclosure 20 and downwardly into the extended position in which the bench extends out of the enclosure 20.

The bench 120 may be collapsible to reduce the overall length of the bench when the bench 120 is stored in the enclosure 20. The bench 120 may comprise an inner member 121 and an outer member 122, with the outer member 122 being slidably connected around the inner member 121 such that the outer member 122 may collapse onto the inner member 121 when the bench 120 is in its collapsed position. The outer member 122 may be slid outwardly with respect to the inner member 121 to adjust the bench 120 into its extended position for use.

The manner in which the bench 120 is secured in the collapsed position to the enclosure 20 may vary in different embodiments. The bench hinge 125 may include a lock or frictional engagement so as to retain the bench 120 in its upright, collapsed position absent application of force. In some embodiments, separate locks, brackets, clamps, magnets, straps, or the like may be utilized to secure the bench 120 in its upright, collapsed position. Once released from the collapsed position, the bench 120 will pivot downwardly into its extended, horizontal position for use.

The bench 120 may include one or more bench legs 127, 128 to stand upright on the floor 15 when the bench 120 is in the extended position such as shown in FIG. 20. The bench legs 127, 128 may be pivotably connected to the bench 120 such that the bench legs 127, 128 collapse against the bench 120 when the bench 120 is collapsed, and extend downwardly, perpendicular to the bench 120, when the bench 120 is in the extended position. In the exemplary embodiment shown in the figures, the bench 120 includes a first bench leg 127 at the distal end of the bench 120 and a second bench leg 128 at the approximate mid-point of the length of the bench 120. It should be appreciated, however, that the number of bench legs 127, 128, and the positioning thereof along the length of the bench 120, may vary in different embodiments.

G. Attachments

A wide range of different types of attachments may be utilized with the exercise rack enclosure system to allow an exerciser to perform a wide range of exercise moves using the exercise rack 99. The exemplary embodiments shown in the figures, and the accompanying description, is meant to show and describe exemplary types of attachments for use with the exercise rack enclosure system. It should be appreciated that such types of attachments shown and described herein are merely for exemplary purposes, and should not be construed as limiting in scope. Various types of attachments, including many known in the art but not shown in the figures, may be utilized in combination with the exercise rack enclosure system.

Figure 16:
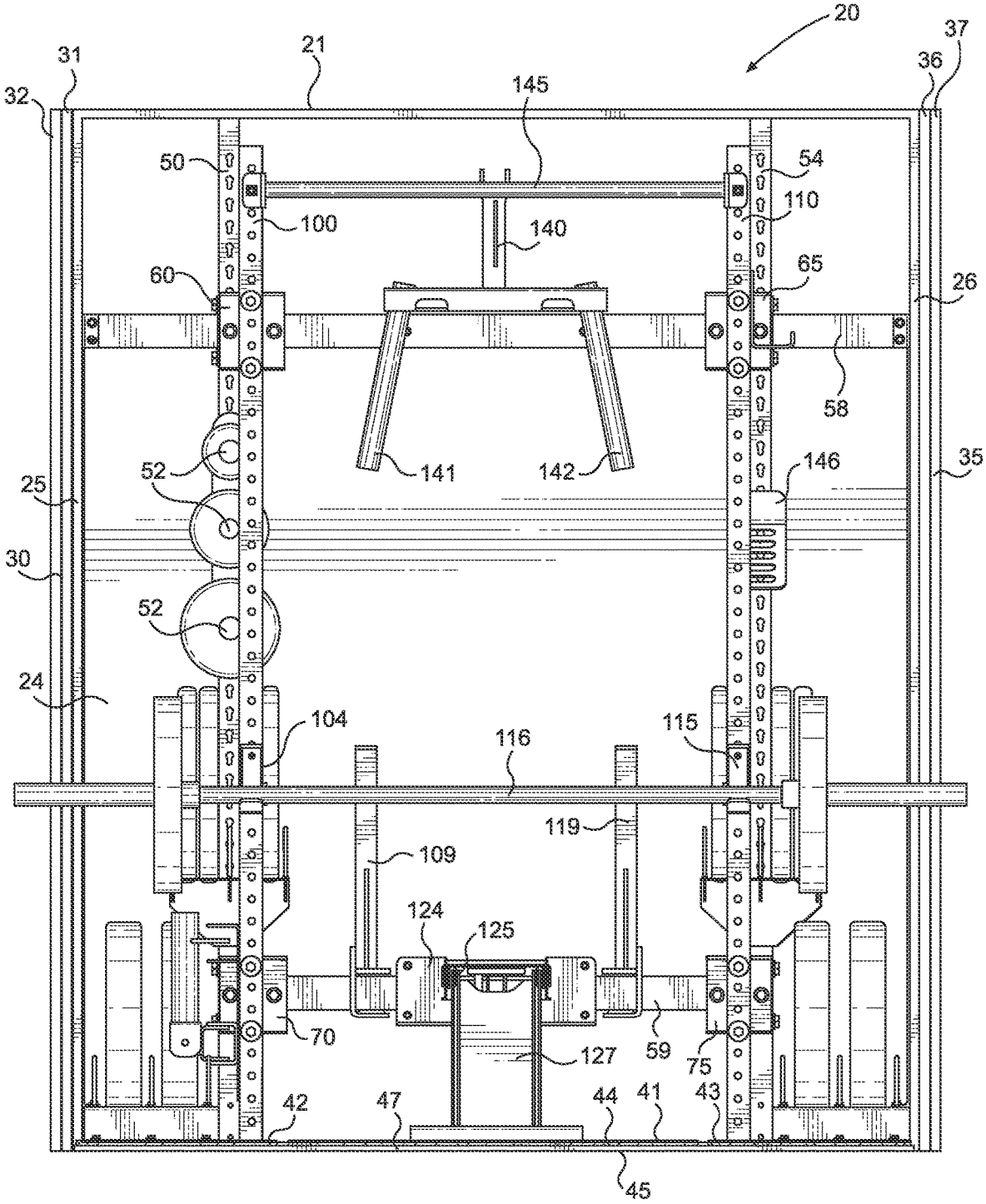
FIG. 16 is a front view of an exercise rack enclosure system with the doors opened and folded against the enclosure and the platform lowered in accordance with an example embodiment.
Figure 17:
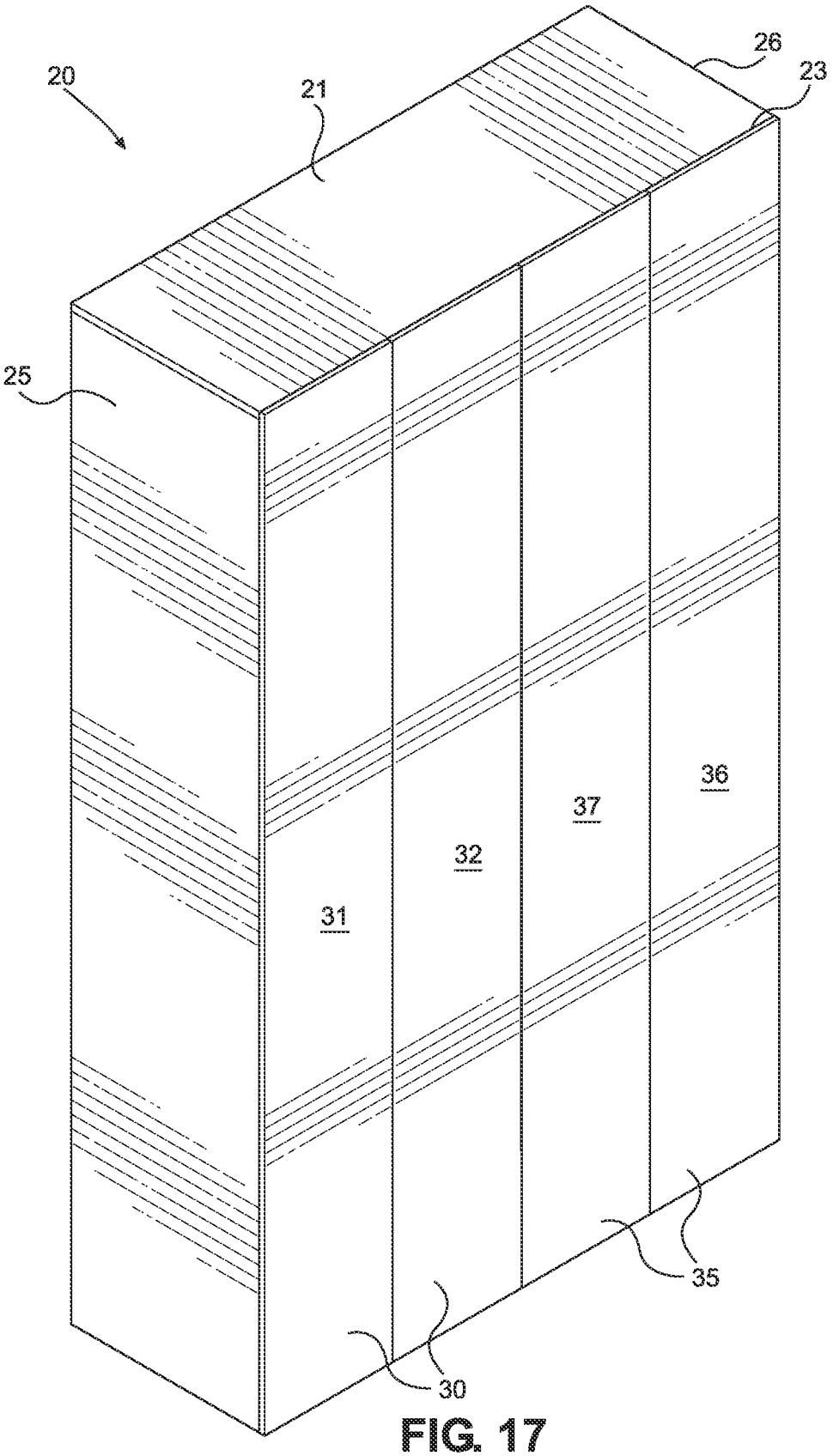
FIG. 17 is a perspective view of an exercise rack enclosure system with the doors closed in accordance with an example embodiment.
Figure 18:
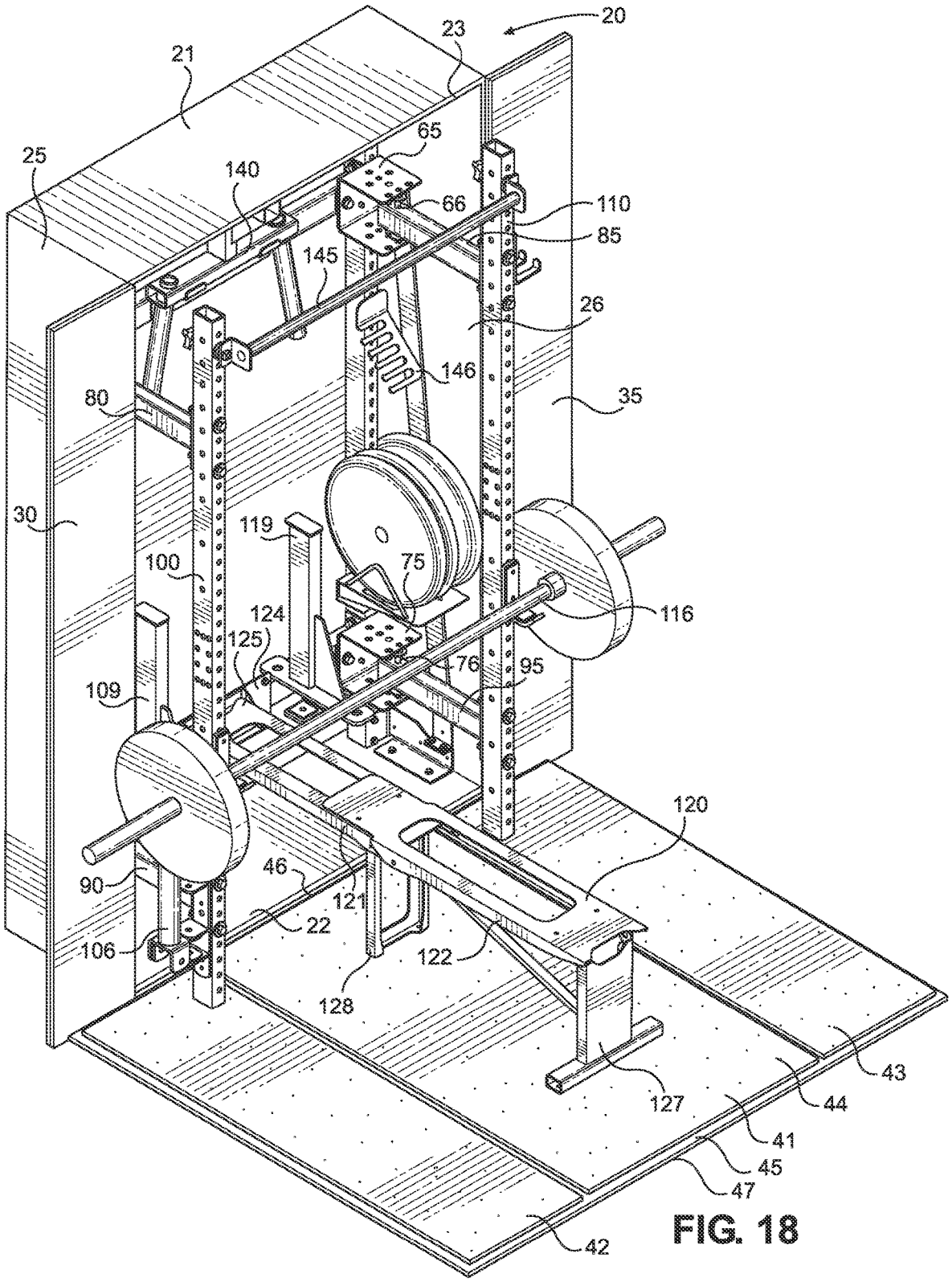
FIG. 18 is a perspective view of an exercise rack enclosure system with the doors opened and the platform lowered in accordance with an example embodiment.
Figure 19:
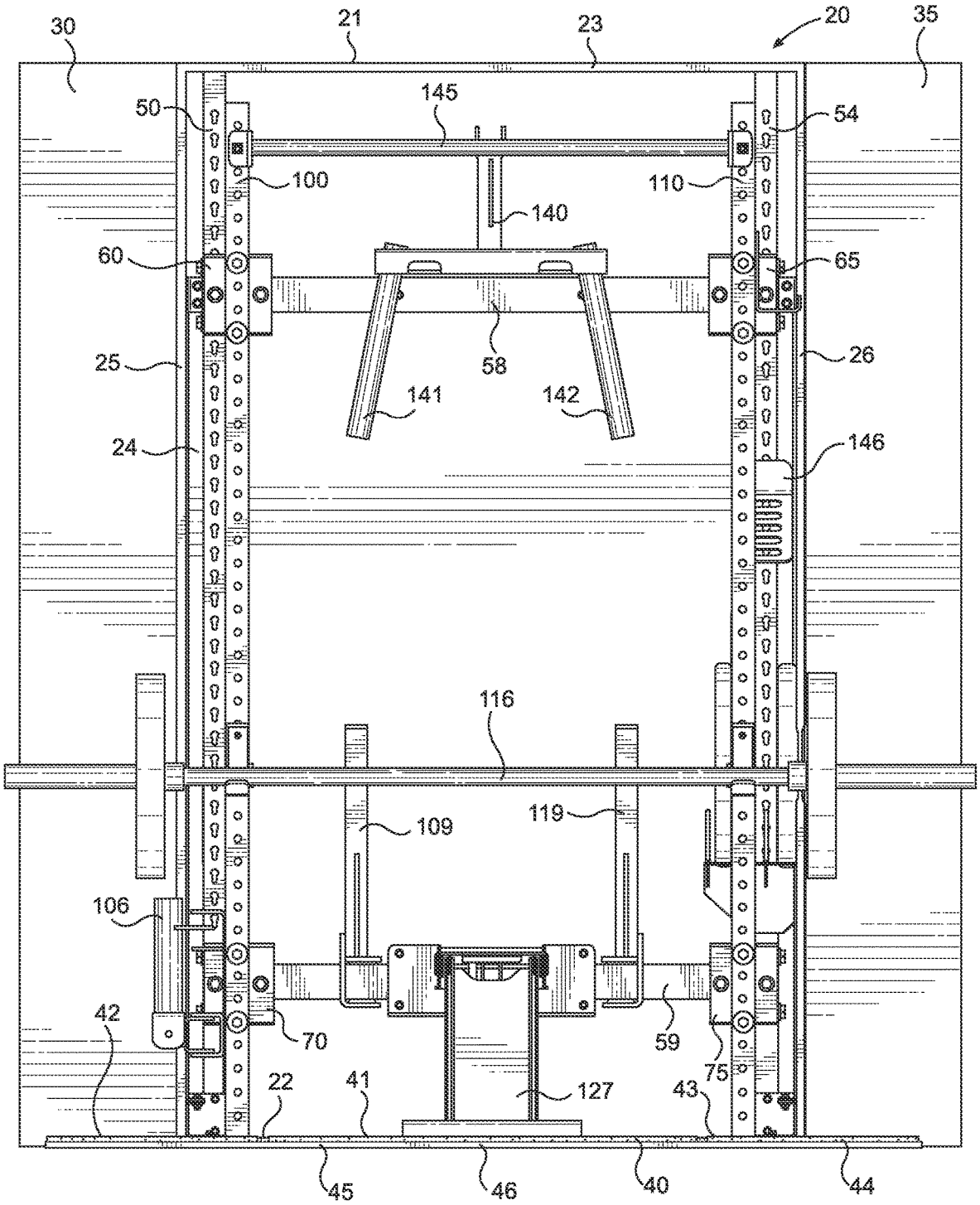
FIG. 19 is a front view of an exercise rack enclosure system with the doors opened and the platform lowered in accordance with an example embodiment.

As shown in FIG. 16, a weight retainer attachment 52 may be connected to the frame 89. In the exemplary embodiment shown in FIG. 16, a weight retainer attachment 52 is shown as being connected to the first side support member 50 of the frame 89. However, in some embodiments, the weight retainer attachment 52 may instead be connected to the second side support member 50. The weight retainer attachment 52 may include one or more pegs or the like to which weights may be removably secured. In the exemplary embodiment shown in the figures, the weight retainer attachment 52 includes three pegs which are vertically-aligned to removably receive one or more weights 139. The positioning of the weight retainer attachment 52 along the height of the first or second side support members 50, 54 may vary in different embodiments, and may be adjusted using fasteners 12 in combination with the openings 51, 55 of the respective side support members 50, 54.

As best shown in FIGS. 2 and 16, one or more weight brackets 53, 57 may be connected to the frame 89 for supporting one or more weights 139 in an upright position. In the exemplary embodiment shown in the figures, a first weight bracket 53 is shown connected to the first side support member 50 and a second weight bracket 57 is shown connected to the second side support member 54. Each of the weight brackets 53, 57 may comprise a plate having retainers on either side such that the weights 139 may be positioned on the plate and retained thereon by the retainers.

As best shown in FIGS. 2 and 16, a hook bracket 56 may be connected to the frame 89 for supporting various items, such as straps, mobility bands, jump ropes, and the like. The hook bracket 56 may comprise a hook which is fixedly or removably connected to the first side support member 50 or the second side support member 54. The hook bracket 56 is shown in FIG. 2 as being connected to the second side support member 54, though the hook bracket 56 in other embodiments may instead be connected to the first side support member 50. The positioning of the hook bracket 56 may be adjusted by connecting the hook bracket 56 to one or more of the openings 51, 55 of the first or second support members 50, 54 using one or more fasteners 12.

As best shown in FIGS. 2 and 16, one or more weight supports 131, 136 may be connected to the floor 22 of the enclosure 20 to support one or more weights 139. The weight supports 131, 136 may be connected to the floor 22 by fasteners 12 or the like. The weight supports 131, 136 may also or alternatively be connected to the frame 89, with the first weight support 131 being connected to the first side support member 50 and the second weight support 136 being connected to the second side support member 54. In some embodiments, the first weight support 131 may also or alternatively be connected to the first anchor member 130 and the second weight support 136 may also or alternatively be connected to the second anchor member 135.

As shown throughout the figures, a dip station attachment 140 may be secured within the enclosure 20. The dip station attachment 140 will generally include a first handle 141 and a second handle 142, with the first and second handles 141, 142 extending diagonally away from each other. The dip station attachment 140 may be stored within the enclosure 20 when not in use, such as by being connected to the first cross support member 59 of the frame 89 as shown in FIG. 4. When ready for use, the dip station attachment 140 may be removed from the frame 89 and connected to the exercise rack 99, such as by use of fasteners 12, to allow an exerciser to perform various dip-related exercise moves.

As best shown in FIG. 4, a pair of rod holders 104, 114 may be provided to allow a weightlifting bar 116 to be used with the exercise rack 99 when the exercise rack 99 is extended. The rod holders 104, 114 may each comprise a bracket, hook, or the like on which a weightlifting bar 116 may be supported. In the exemplary embodiment shown in the figures, a first rod holder 104 is connected to the first rack member 100 and a second rod holder 114 is connected to the second rack member 110. The positioning of the rod holders 104, 114 along the height of the respective rack members 100, 110 may be adjusted using the openings 103, 113 of the rack members 100, 110 in combination with fasteners 12.

A weightlifting bar 116 may also be secured against the exercise rack enclosure system for use when needed by the exerciser. In the embodiment shown in FIG. 7, a rod retainer 115 comprised of a bracket, hook, or the like is shown connected to the second side support member 54. The weightlifting bar 116 may be stored by securing the weightlifting bar 116 against the second side support member 54, with a flange 117 of the weightlifting bar 116 engaging within the rod retainer 115 such as shown in FIG. 2. It should be appreciated that, in some embodiments, the rod retainer 115 may instead be connected to the first side support member 50 and thus the weightlifting bar 116 may be secured against the first side support member 50 instead of the second side support member 54.

Figure 7:
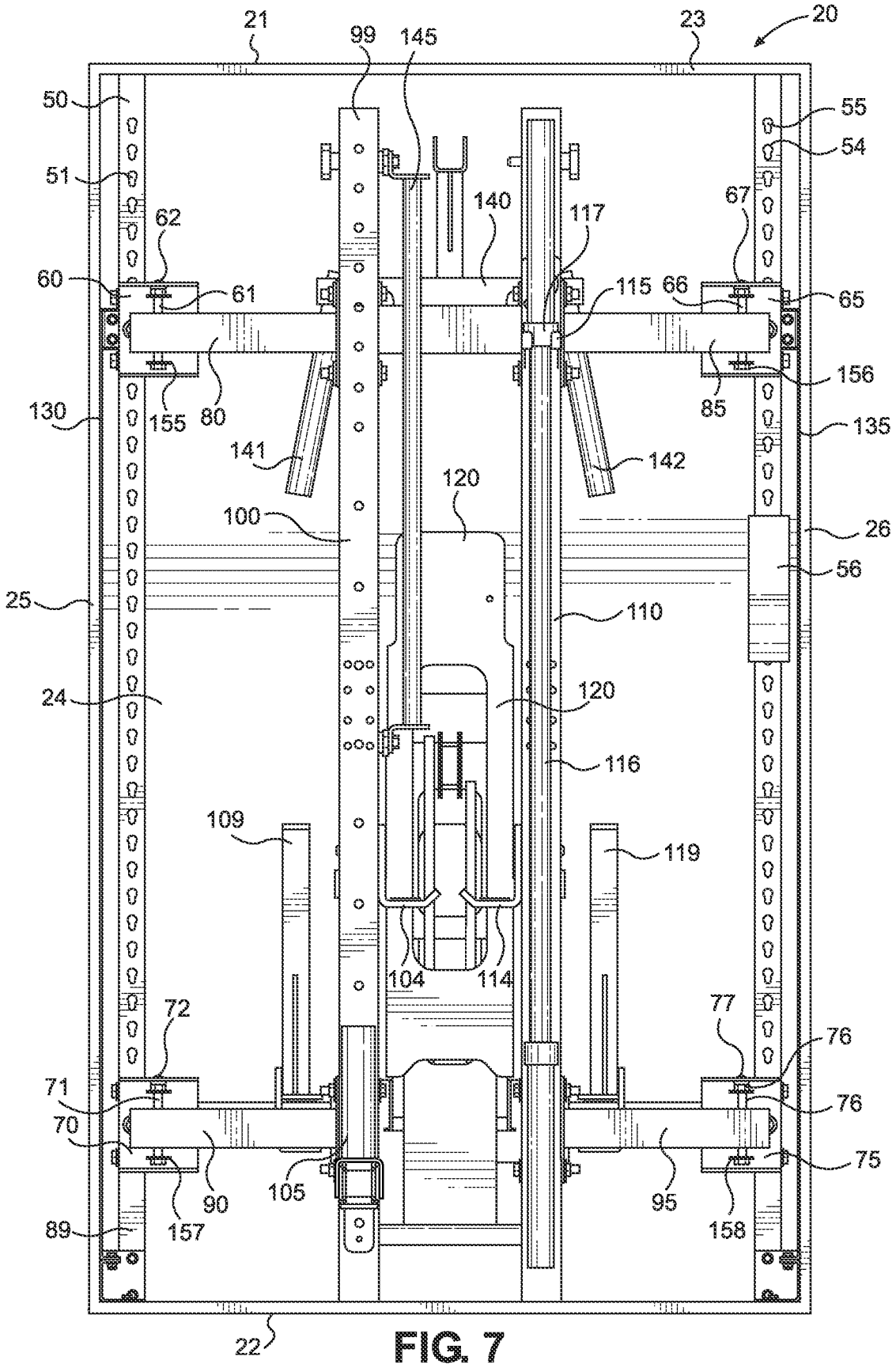
FIG. 7 is a front view of an exercise rack enclosure system with the exercise rack in a collapsed position in accordance with an example embodiment.

As best shown in FIGS. 4 and 7, a pair of spotter arms 109, 119 may be pivotably connected to the frame 89 and adjustable between a raised position for storage and a lowered position for use. The spotter arms 109, 119 may be pivotably connected to the second cross support member 59 as shown in the figures on either side of the bench 120. Thus, a first spotter arm 109 may be positioned on a first side of the bench 120 and a second spotter arm 119 may be positioned on a second side of the bench 120. When lowered, the spotter arms 109, 119 may function to prevent injury to an exerciser when weightlifting with the weightlifting bar 116.

As best shown in FIG. 6, the exercise rack enclosure system may include a landmine attachment 106 which may be utilized in combination with the weightlifting bar 116 to perform various exercises. The landmine attachment 106 may be connected to the exercise rack 99. In the exemplary embodiment shown in the figures, the landmine attachment 106 is shown as being connected to the first rack member 100. However, it should be appreciated that the landmine attachment 106 may instead be connected to the second rack member 110 in other embodiments. The landmine attachment 106 may comprise a sleeve into which an end of the weightlifting bar 116 may be inserted. The sleeve may be adjustable, such as by pivoting, between an upright position for storage against and parallel to the exercise rack 99, and a lowered position for use in which the sleeve is perpendicular or angled with respect to the exercise rack 99.

As best shown in FIGS. 7 and 8, the exercise rack enclosure system may include a pull-up bar 145 which may be connected to the first rack member 100 or the second rack member 110 parallel to the first or second rack members 100, 110 for storage and connected across the first and second rack members 100, 110 perpendicularly for use to perform pull-ups. The pull-up bar 145 may include brackets at either end through which fasteners 12 may extend to secure the pull-up bar 145 against either of the rack members 100, 110 utilizing the openings 103, 113 thereof such as shown in FIG. 7. The pull-up bar 145 may be removed from the rack member 100, 110 to which it is attached and then reconnected to extend across and between the first and second rack members 100, 110 for use such as shown in FIG. 8.

Figure 3:
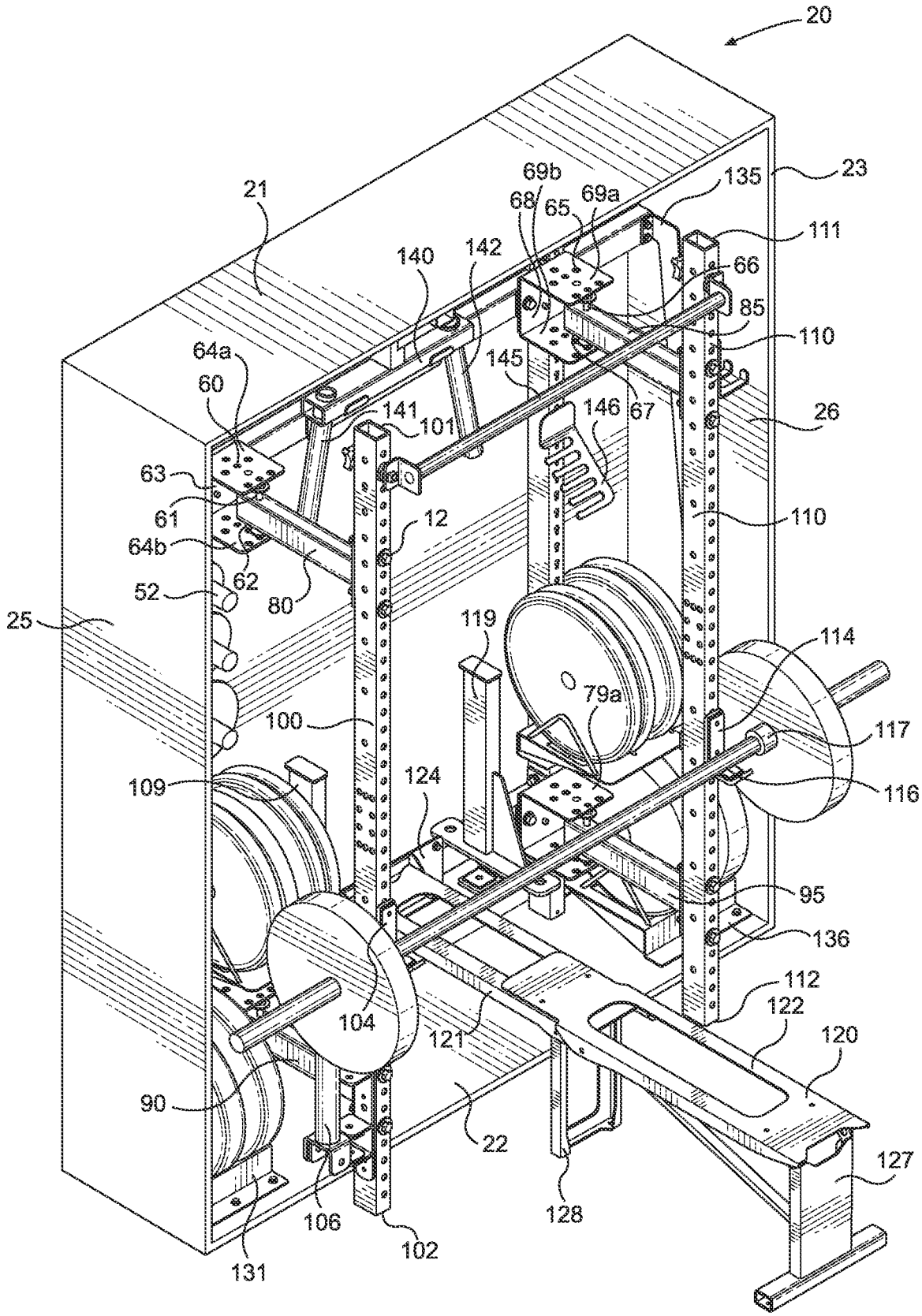
FIG. 3 is a perspective view of an exercise rack enclosure system with the exercise rack in an extended position in accordance with an example embodiment.

As best shown in FIGS. 3 and 4, a mobility band support 146 may be connected to the support frame 89 for use in supporting various exercises using mobility bands. The mobility band support 146 may comprise a comb-like shape with a plurality of slots defined by a plurality of projections to which the mobility band may be connected for performance of various exercise moves. The mobility band support 146 is shown as being connected to the second side support member 54, but in other embodiments may instead be connected to the first side support member 50, or to either rack member 100, 110, using fasteners 12.

H. Operation of Preferred Embodiment

In use, the enclosure 20 may first be set up in an exercise space such as a room, garage, or studio. The enclosure 20 is configured to be free-standing, but may be anchored to a wall or other structure to prevent the enclosure 20 from toppling over, such as due to an earthquake. The enclosure 20 may have the appearance of a standard piece of furniture, such as but not limited to a hutch, cabinet, chest, dresser, bookcase, wardrobe (e.g., armoire), or the like, so that the enclosure 20 may have an aesthetic appeal that matches with other items commonly found in living spaces of a home, such as a living room or bedroom, or in a garage.

After the enclosure 20 is set up, the enclosure 20 will stand upright on the floor 15 or an underlying ground surface. The exercise rack 99 may be folded or collapsed within the interior space 28 of the enclosure 20 such that the one or more doors 30, 35, if used, may be closed to enclose the interior space 28 and conceal the exercise rack 99. In some embodiments, however, the one or more doors 30, 35 may be omitted entirely such as shown in FIGS. 1-10B.

Figure 14:
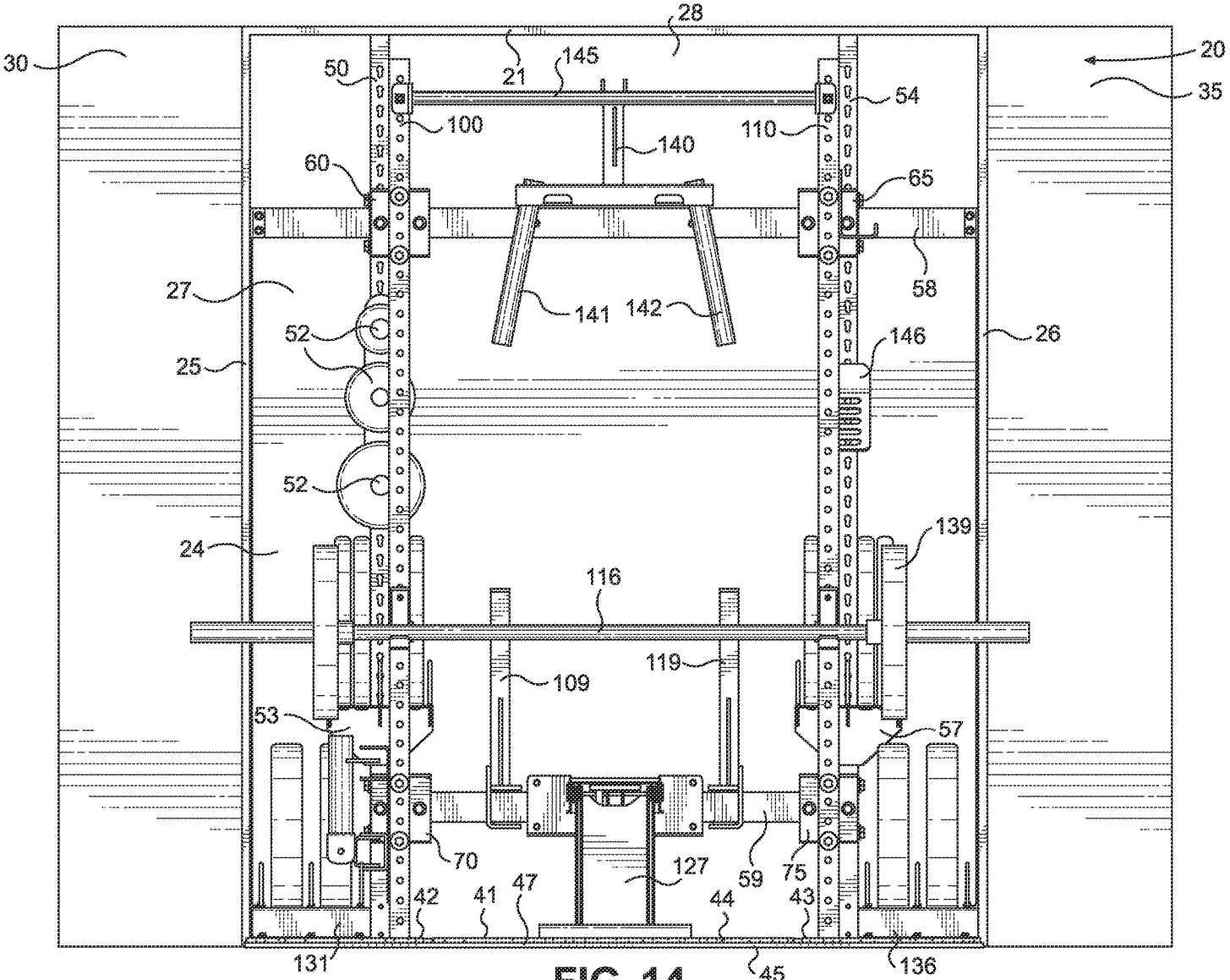
FIG. 14 is a front view of an exercise rack enclosure system with the doors opened and the platform lowered in accordance with an example embodiment.

When ready to exercise, the one or more doors 30, 35 may be opened to provide access to the interior space 28 of the enclosure 20 through the front opening 27 thereof. The one or more doors 30, 35 may be collapsed together (e.g., the first and second segments 31, 32 of the first door 30 may be folded against each other and the third and fourth segments 36, 37 of the second door 35 may be folded against each other). The doors 30, 35 may be positioned perpendicular to the first and second sidewalls 25, 26 such as shown in FIGS. 13 and 14, or may be positioned against the first and second sidewalls 25, 26 such as shown in FIGS. 15 and 16.

If a platform 40 is included, the platform 40 may be lowered to rest upon the floor 15. The platform 40 may be unfolded, with the first and second side segments 42, 43 being folded outwardly from either side of the central segment 41. The platform 40 will provide a surface on which the exercise rack 99 and bench 120 may rest when in use without damaging the exercise rack 99, bench 120, or floor 15.

An exerciser may grasp the exercise rack 99, such as by grasping the first and second rack members 100, 110 individually or collectively, and pivot the exercise rack 99 into its extended position in which it extends through the front opening 27 of the enclosure 20. The bench 120 may be lowered and extended out through the front opening 27 to rest upon the floor 15.

When pivoting the exercise rack 99, the linkages 80, 85, 90, 95 of the exercise rack 99 will pivot about a vertical axis with respect to the upper and lower connectors 60, 65, 70, 75 until the rack members 100, 110 extend out of the enclosure 20. The rack members 100, 110 may be vertically-adjusted downwardly such that the lower ends 102, 112 of the rack members 100, 110 rest upon the floor 15 or platform 40.

The exercise rack 99 is then ready for use. Various attachments may be utilized to perform a wide range of exercise moves. For example, the first rod holder 104 may be connected to the first rack member 100 and the second rod holder 114 may be connected to the second rack member 110. A weightlifting bar 116 may then be positioned across and on the rod holders 104, 114 for use. Weights 139 may be retrieved from the weight brackets 53, 57 and/or weight supports 131, 136 and secured on either end of the weightlifting bar 116. The exerciser may lower the spotter arms 109, 119, position herself on the bench 120, and perform weightlifting moves by raising and lowering the weightlifting bar 116 with attached weights 139.

As another example, the dip station attachment 140 may be disconnected from the frame 89 and connected to the exercise rack 99. The exerciser may then perform various exercise moves using the handles 141, 142 of the dip station attachment 140. As a further example, the pull-up bar 145 may be disconnected from the exercise rack 99 and then reconnected to extend across and between the rack members 100, 110 for use performing pull-ups. A wide range of other exercise moves may be performed utilizing various other attachments either shown/described herein or known in the art for use with an exercise rack 99.

When finished exercising, the exercise rack 99 may be collapsed into the enclosure 20. The first and second rack members 100, 110 may be individually or collectively grasped by the exerciser and pivoted inwardly. If necessary, the exercise rack 99 may be first raised upwardly and then pivoted inwardly. The bench 120 may also be collapsed and raised upwardly within the enclosure 20 for storage. If a platform 40 is utilized, the platform 40 may be collapsed onto itself and raised upwardly into the enclosure 20. If doors 30, 35 are utilized, the doors 30, 35 may then be closed, with the platform 40 being positioned directly being the doors 30, 35. The exercise rack enclosure system will then be closed with the appearance of a standard piece of furniture awaiting further use.

Unless otherwise defined, all technical and scientific terms used herein have the same meaning as commonly understood by one of ordinary skill in the art to which this invention belongs. Although methods and materials similar to or equivalent to those described herein can be used in the practice or testing of the exercise rack enclosure system, suitable methods and materials are described above. All patent applications, patents, and printed publications cited herein are incorporated herein by reference in their entireties, except for any definitions, subject matter disclaimers or disavowals, and except to the extent that the incorporated material is inconsistent with the express disclosure herein, in which case the language in this disclosure controls. The exercise rack enclosure system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise rack enclosure system, comprising:

an enclosure including a ceiling, a floor, a rear wall, a first sidewall, and a second sidewall, wherein the ceiling is connected to the rear wall, the first sidewall, and the second sidewall, wherein the floor is connected to the rear wall, the first sidewall, and the second sidewall, wherein the rear wall is connected to the floor, the ceiling, the first sidewall, and the second sidewall, wherein the enclosure includes a front opening, and wherein the enclosure includes an interior space accessible through the front opening;

at least one door pivotably connected to the enclosure, wherein the at least one door is adapted to selectively enclose the front opening;

a frame attached to the rear wall of the enclosure; and an exercise rack pivotably connected to the frame, wherein the exercise rack is adjustable between a collapsed position in which the exercise rack is completely within the interior space of the enclosure and an extended position in which a portion of the exercise rack extends outwardly from the enclosure through the front opening, wherein the exercise rack is pivotably connected to the frame by at least one hinge, wherein the exercise rack is adapted to pivot about a vertical axis extending through the at least one hinge, and wherein the exercise rack is adapted to slide upwardly and downwardly along the vertical axis extending through the at least one hinge.

2. The exercise rack enclosure system of claim 1, wherein the exercise rack is oriented parallel to the rear wall of the enclosure when the exercise rack is in the collapsed position.

3. The exercise rack enclosure system of claim 2, wherein the exercise rack is oriented perpendicular to the rear wall of the enclosure when the exercise rack is in the extended position.

4. The exercise rack enclosure system of claim 1, wherein the exercise rack is vertically adjustable between a raised position and a lowered position.

5. The exercise rack enclosure system of claim 4, wherein a lower end of the exercise rack is adapted to rest upon the floor of the enclosure when the exercise rack is in the raised position.

6. The exercise rack enclosure system of claim 5, wherein the lower end of the exercise rack is adapted to rest upon a surface underlying the enclosure when the exercise rack is in the lowered position.

7. The exercise rack enclosure system of claim 1, wherein the at least one door is comprised of a first door pivotably connected to a first side of the enclosure and a second door pivotably connected to a second side of the enclosure.

8. The exercise rack enclosure system of claim 7, wherein the first door is comprised of a first segment and a second segment pivotably connected to the first segment, and wherein the second door is comprised of a third segment and a fourth segment pivotably connected to the third segment.

9. The exercise rack enclosure system of claim 1, further comprising a platform pivotably connected to the floor of the enclosure, wherein the platform is adjustable between a raised position in which the platform is completely within the interior space of the enclosure and a lowered position in which a portion of the platform extends outwardly from the enclosure.

10. The exercise rack enclosure system of claim 9, wherein the exercise rack is adapted to rest upon the platform when the exercise rack is in the extended position and the platform is in the lowered position.

11. The exercise rack enclosure system of claim 1, further comprising a bench pivotably connected to the rear wall of the enclosure, wherein the bench is adjustable between a first position in which the bench is secured against the rear wall of the enclosure and a second position in which the bench at least partially extends out of the front opening of the enclosure.

12. The exercise rack enclosure system of claim 1, wherein the frame is comprised of a first support member and a second support member, wherein the exercise rack is comprised of a first rack member and a second rack member, wherein the first rack member is pivotably connected to the first support member by a first hinge, and wherein the second rack member is pivotably connected to the second support member by a second hinge.

13. The exercise rack enclosure system of claim 12, wherein the first rack member is adapted to swing towards the second rack member and wherein the second rack member is adapted to swing towards the first rack member.

14. The exercise rack enclosure system of claim 12, wherein the first rack member and the second rack member are each vertically adjustable between a raised position and a lowered position.

15. The exercise rack enclosure system of claim 12, wherein the frame includes a cross support member connected to the rear wall between the first support member and the second support member, and further comprising a bench pivotably connected to the cross support member.

16. The exercise rack enclosure system of claim 15, further comprising a first spotter arm pivotably connected to the cross support member on a first side of the bench and a second spotter arm pivotably connected to the cross support member on a second side of the bench.

17. The exercise rack enclosure system of claim 12, further comprising a platform pivotably connected to the floor of the enclosure, wherein the platform is pivotably adjustable between a raised position and a lowered position, and wherein the first rack member and the second rack member are each adapted to rest upon the platform when the platform is in the lowered position and the exercise rack is in the extended position.

18. The exercise rack enclosure system of claim 12, further comprising a first weight support connected to the floor of the enclosure between the first support member and the first sidewall and a second weight support connected to the floor of the enclosure between the second support member and the second sidewall, and wherein the first weight support and the second weight support are each adapted to support one or more weights.

19. An exercise rack enclosure system, comprising:

an enclosure including a ceiling, a floor, a rear wall, a first sidewall, and a second sidewall, wherein the ceiling is connected to the rear wall, the first sidewall, and the second sidewall, wherein the floor is connected to the rear wall, the first sidewall, and the second sidewall, wherein the rear wall is connected to the floor, the ceiling, the first sidewall, and the second sidewall, wherein the enclosure includes a front opening, and wherein the enclosure includes an interior space accessible through the front opening;

at least one door pivotably connected to the enclosure, wherein the at least one door is adapted to selectively enclose the front opening;

a first side support member attached to the rear wall of the enclosure;

a first upper hinge connected to the first side support member at or near an upper end of the first side support member;

a first lower hinge connected to the first side support member at or near a lower end of the first side support member;

a second side support member attached to the rear wall of the enclosure;

a second upper hinge connected to the second side support member at or near an upper end of the second side support member;

a second lower hinge connected to the second side support member at or near a lower end of the second side support member; and an exercise rack including a first rack member and a second rack member, wherein the first rack member is pivotably connected to the first upper hinge by a first upper linkage, wherein the first rack member is pivotably connected to the first lower hinge by a first lower linkage, wherein the first upper linkage is vertically adjustable with respect to the first upper hinge, and wherein the first lower linkage is vertically adjustable with respect to the first lower hinge;

wherein the second rack member is pivotably connected to the second upper hinge by a second upper linkage, wherein the second rack member is pivotably connected to the second lower hinge by a second lower linkage, wherein the second upper linkage is vertically adjustable with respect to the second upper hinge, and wherein the second lower linkage is vertically adjustable with respect to the second lower hinge;

wherein the first rack member is adapted to swing towards and away from the second rack member, and wherein the second rack member is adapted to swing towards and away from the first rack member;

wherein the exercise rack is adjustable between a collapsed position in which the first rack member and the second rack member are each completely within the interior space of the enclosure and an extended position in which the first rack member and the second rack member each extend outwardly from the enclosure through the front opening;

wherein the exercise rack is vertically adjustable between a raised position and a lowered position, wherein a lower end of the exercise rack is adapted to rest upon the floor of the enclosure when the exercise rack is in the raised position, and wherein the lower end of the exercise rack is adapted to rest upon a surface underlying the enclosure when the exercise rack is in the lowered position.

20. An exercise rack enclosure system, comprising:

an enclosure including a ceiling, a floor, a rear wall, a first sidewall, and a second sidewall, wherein the ceiling is connected to the rear wall, the first sidewall, and the second sidewall, wherein the floor is connected to the rear wall, the first sidewall, and the second sidewall, wherein the rear wall is connected to the floor, the ceiling, the first sidewall, and the second sidewall, wherein the enclosure includes a front opening, and wherein the enclosure includes an interior space accessible through the front opening;

at least one door pivotably connected to the enclosure, wherein the at least one door is adapted to selectively enclose the front opening;

a frame attached to the rear wall of the enclosure; and an exercise rack pivotably connected to the frame, wherein the exercise rack is adjustable between a collapsed position in which the exercise rack is completely within the interior space of the enclosure and an extended position in which a portion of the exercise rack extends outwardly from the enclosure through the front opening, wherein the exercise rack is vertically adjustable between a raised position and a lowered position, and wherein a lower end of the exercise rack is adapted to rest upon the floor of the enclosure when the exercise rack is in the raised position.

21. The exercise rack enclosure system of claim 20, wherein the exercise rack is oriented parallel to the rear wall of the enclosure when the exercise rack is in the collapsed position.

22. The exercise rack enclosure system of claim 21, wherein the exercise rack is oriented perpendicular to the rear wall of the enclosure when the exercise rack is in the extended position.

23. The exercise rack enclosure system of claim 20, wherein the lower end of the exercise rack is adapted to rest upon a surface underlying the enclosure when the exercise rack is in the lowered position.

24. The exercise rack enclosure system of claim 20, wherein the at least one door is comprised of a first door pivotably connected to a first side of the enclosure and a second door pivotably connected to a second side of the enclosure.

25. The exercise rack enclosure system of claim 24, wherein the first door is comprised of a first segment and a second segment pivotably connected to the first segment, and wherein the second door is comprised of a third segment and a fourth segment pivotably connected to the third segment.

26. The exercise rack enclosure system of claim 20, further comprising a platform pivotably connected to the floor of the enclosure, wherein the platform is adjustable between a raised position in which the platform is completely within the interior space of the enclosure and a lowered position in which a portion of the platform extends outwardly from the enclosure.

27. The exercise rack enclosure system of claim 26, wherein the exercise rack is adapted to rest upon the platform when the exercise rack is in the extended position and the platform is in the lowered position.

28. The exercise rack enclosure system of claim 20, further comprising a bench pivotably connected to the rear wall of the enclosure, wherein the bench is adjustable between a first position in which the bench is secured against the rear wall of the enclosure and a second position in which the bench at least partially extends out of the front opening of the enclosure.

29. The exercise rack enclosure system of claim 20, wherein the frame is comprised of a first support member and a second support member, wherein the exercise rack is comprised of a first rack member and a second rack member, wherein the first rack member is pivotably connected to the first support member by a first hinge, and wherein the second rack member is pivotably connected to the second support member by a second hinge.

30. The exercise rack enclosure system of claim 20, further comprising a weight support connected to the floor of the enclosure.

* * * * *